US011047110B2

(12) United States Patent
Binstock et al.

(10) Patent No.: US 11,047,110 B2
(45) Date of Patent: Jun. 29, 2021

(54) HYDRAULIC SUB-ASSEMBLY FOR A POWER MACHINE

(71) Applicant: Clark Equipment Company, West Fargo, ND (US)

(72) Inventors: Mark Binstock, Bismarck, ND (US); Scott LaCoe, Bismarck, ND (US); Kjell Kroh, Mandan, ND (US); Kenneth L. Dieter, Danvers, MN (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 0 days.

(21) Appl. No.: 16/799,570

(22) Filed: Feb. 24, 2020

(65) Prior Publication Data

US 2020/0271143 A1 Aug. 27, 2020

Related U.S. Application Data

(60) Provisional application No. 62/809,282, filed on Feb. 22, 2019.

(51) Int. Cl.

| | |
|---|---|
| ***E02F 9/08*** | (2006.01) |
| ***F15B 21/0423*** | (2019.01) |
| ***E02F 9/20*** | (2006.01) |
| ***F15B 21/041*** | (2019.01) |
| ***E02F 9/16*** | (2006.01) |

(52) U.S. Cl.

CPC ..... *E02F 9/0875* (2013.01); *E02F 9/0808* (2013.01); *E02F 9/0858* (2013.01); *E02F 9/163* (2013.01); *E02F 9/2004* (2013.01); *F15B 21/041* (2013.01); *F15B 21/0423* (2019.01)

(58) Field of Classification Search

CPC ..... E02F 9/0808; E02F 9/0841; E02F 9/0858; E02F 9/0875; E02F 9/16; E02F 9/163; E02F 9/2004; E02F 9/2267; E02F 9/2275; F15B 21/041; F15B 21/0423

See application file for complete search history.

(56) References Cited

U.S. PATENT DOCUMENTS 3,240,284 A * 3/1966 Finneman ..... B62D 53/025 180/235
3,521,719 A * 7/1970 Forpahl ..... B62D 53/026 180/235

(Continued)

FOREIGN PATENT DOCUMENTS

| | | |
|---|---|---|
| EP | 2700753 A1 | 2/2014 |
| EP | 3190236 A1 | 7/2017 |
| JP | 2016069864 A | 5/2016 |

OTHER PUBLICATIONS

International Searching Authority. International Search Report and Written Opinion for application PCT/US2020/019544. dated May 29, 2020.

*Primary Examiner* — Abiy Teka
*Assistant Examiner* — Matthew Wiblin

(57) ABSTRACT

A hydraulic sub-assembly of the present disclosure can be used with a power machine. The hydraulic sub-assembly can include a support panel and a plurality of components secured to the support panel, to be supported by the support panel relative to the power machine. The plurality of components can include a control valve configured to provide hydraulic control of the work functions and hydraulic. The support panel can be configured to be a structural portion of a cab of the power machine.

19 Claims, 13 Drawing Sheets

(56) References Cited

U.S. PATENT DOCUMENTS

| | | | | |
|---|---|---|---|---|
| 3,888,372 | A * | 6/1975 | Gorby | B62D 53/02 414/713 |
| 2005/0210717 | A1* | 9/2005 | Ueda | E02F 9/163 37/443 |
| 2005/0210718 | A1* | 9/2005 | Ueda | E02F 9/0833 37/466 |
| 2013/0025170 | A1* | 1/2013 | Caillieret | E02F 9/2271 37/425 |
| 2013/0071212 | A1* | 3/2013 | Yunoue | E02F 9/0808 414/685 |
| 2013/0313398 | A1 | 11/2013 | Sayre | |
| 2019/0119883 | A1* | 4/2019 | Ichihara | B60K 15/03 |

* cited by examiner

HYDRAULIC SUB-ASSEMBLY FOR A POWER MACHINE

CROSS-REFERENCE TO RELATED APPLICATIONS

This application claims priority to U.S. Provisional Patent Application No. 62/809,282, filed Feb. 22, 2019, the entirety of which is incorporated herein by reference.

BACKGROUND

This disclosure is directed toward power machines. More particularly, this disclosure relates to hydraulic sub-assemblies for power machines. Power machines, for the purposes of this disclosure, include any type of machine that generates power to accomplish a task or a variety of tasks. One type of power machine is a work vehicle. Work vehicles, such as loaders, are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Conventional power machines can include hydraulic circuits and associated equipment, such as a work actuator circuit and a pump that is configured to provide pressurized hydraulic fluid to the work actuator circuit. In some cases, a work actuator circuit is in communication with a work actuator that can include lift cylinders, tilt cylinders, telescoping cylinders, and the like for execution of certain work functions. The work actuator circuit can include valves and other devices to selectively provide pressurized hydraulic fluid to the various work actuators, and the valves and other devices can be mounted, for example, at various locations along the power machine. This configuration can also require fluid conduits for the work actuator circuit, which can direct fluid between the various valves and other components and can be arranged at various locations and orientations about the power machine.

The discussion above is merely provided for general background information and is not intended to be used as an aid in determining the scope of the claimed subject matter.

SUMMARY

Some embodiments of the present disclosure provide an improved arrangement of a hydraulic sub-assembly that can be secured to and used with a power machine. Some arrangements of a hydraulic sub-assembly according to the present disclosure can provide a support panel upon which various components of the work actuator circuit can be directly or indirectly mounted. Accordingly, among other benefits, some embodiments of the present disclosure provide a sub-assembly that can reduce the amount of material and manufacturing time that may be needed for assembly of the power machine.

In some embodiments, a hydraulic sub-assembly for use with a power machine with a cab can include a support panel. A control valve can be secured to the support panel to be supported by the support panel. The control valve being configured to provide hydraulic control of work functions on the power machine. The support panel can be configured to be secured to the power machine to define a structural portion of the cab.

In some embodiments, a power machine can include a cab having a lateral side, and an operator station. A hydraulic sub-assembly can include a single-piece support panel and a plurality of components that are secured to the unitary support panel to be supported by the unitary support panel relative to the frame. The phrase single-piece refers, in the context of this discussion to a support panel made from a unitary piece of material as opposed to two or more panels that are fastened together. The plurality of components can include: a control valve; an operator input device configured for hydraulic control of work functions, the operator input device being mounted on and in hydraulic communication with the control valve; hydraulic conduits including one or more tube lines and one or more flexible hoses; a cooler bracket; a hydraulic cooler secured to the cooler bracket to be spaced laterally apart from the single-piece support panel to provide clearance between the hydraulic cooler and the single-piece support panel for one or more of the hydraulic conduits; and a hydraulic filter secured on an opposite side of the single-piece support panel from at least one of the control valve, the operator input device, the pilot valve, the cooler bracket, or the hydraulic cooler. The single-piece support panel can be configured to be secured to the lateral side of the cab to define a structural portion of the cab, with one or more of the control valve, the operator input device, the pilot valve, the cooler bracket, and the hydraulic cooler positioned opposite the single-piece support panel from the operator station.

In some embodiments, a method of manufacture is provided for a power machine with a cab. The method of manufacture can include assembling a hydraulic sub-assembly, including: providing a single-piece support panel; and securing a control valve to the single-piece support panel. The method can further include securing the hydraulic sub-assembly to the power machine to define a structural portion of the cab.

In some embodiments, a method of manufacture is provided for a power machine with a cab having a lateral side, and an operator station. The method of manufacture can include assembling a hydraulic sub-assembly by providing a single-piece support panel and securing a plurality of components to the single-piece support panel. The plurality of components include: a control valve; an operator input device that is configured for hydraulic control of work functions via hydraulic communication with the control valve; a pilot valve in hydraulic communication with the control valve for hydraulic control of the work functions; hydraulic conduits including one or more tube lines and one or more flexible hoses; a cooler bracket; a hydraulic cooler secured to the cooler bracket to provide clearance between the hydraulic cooler and the single-piece support panel for one or more of the hydraulic conduits; and a hydraulic filter secured on an opposite side of the single-piece support panel from at least one of the control valve, the operator input device, the pilot valve, the cooler bracket, or the hydraulic cooler. The hydraulic sub-assembly can be secured to the power machine to define a structural portion of the lateral side of the cab, with one or more of the control valve, the operator input device, the pilot valve, the cooler bracket, and the hydraulic cooler positioned opposite the single-piece support panel from operator station, and with the hydraulic filter positioned at least partly beneath the operator station.

In some embodiments, a hydraulic sub-assembly is provided for use with a power machine with a cab that includes an operator station. The hydraulic sub-assembly can include a support panel configured to be secured to a lateral side of the cab, and a plurality of components secured to and supported by the support panel. The plurality of components can include: a control valve; an operator input device configured for control of hydraulic work functions of the power machine, the operator input device being mounted on and in hydraulic communication with the control valve; a pilot valve configured to facilitate interoperation of the control valve and the operator input device; hydraulic conduits including one or more tube lines and one or more flexible hoses; a hydraulic cooler; and a hydraulic filter. The support panel can be configured to define a structural side wall of the cab, with one or more of the control valve, the operator input device, the pilot valve, or the hydraulic cooler positioned opposite the support panel from the operator station.

In some embodiments, an articulated loader is provided, including a cab that defines an operator station and is supported on a front frame member of an articulated frame. A hydraulic sub-assembly of the articulated loader can include a support panel and a control valve. The support panel can form at least part of a structural side wall of the cab, laterally adjacent to the operator station. The control valve can be secured to the support panel to be supported by the support panel relative to the cab. The control valve can be configured to provide hydraulic control of work functions of the articulated loader based on inputs from an operator within the operator station.

Some embodiments provide a method of manufacturing a power machine. The method can include assembling a hydraulic sub-assembly, including: providing a support panel, and securing a control valve and a plurality of hydraulic components to the support panel. The method can also include securing the hydraulic sub-assembly, including the control valve and the hydraulic components, to a frame of the power machine, to support the control valve and the plurality of hydraulic components relative to the frame, with the support panel defining a structural portion of a lateral side of a cab of the power machine.

This Summary and the Abstract are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter.

DRAWINGS

DESCRIPTION

Figure 1:
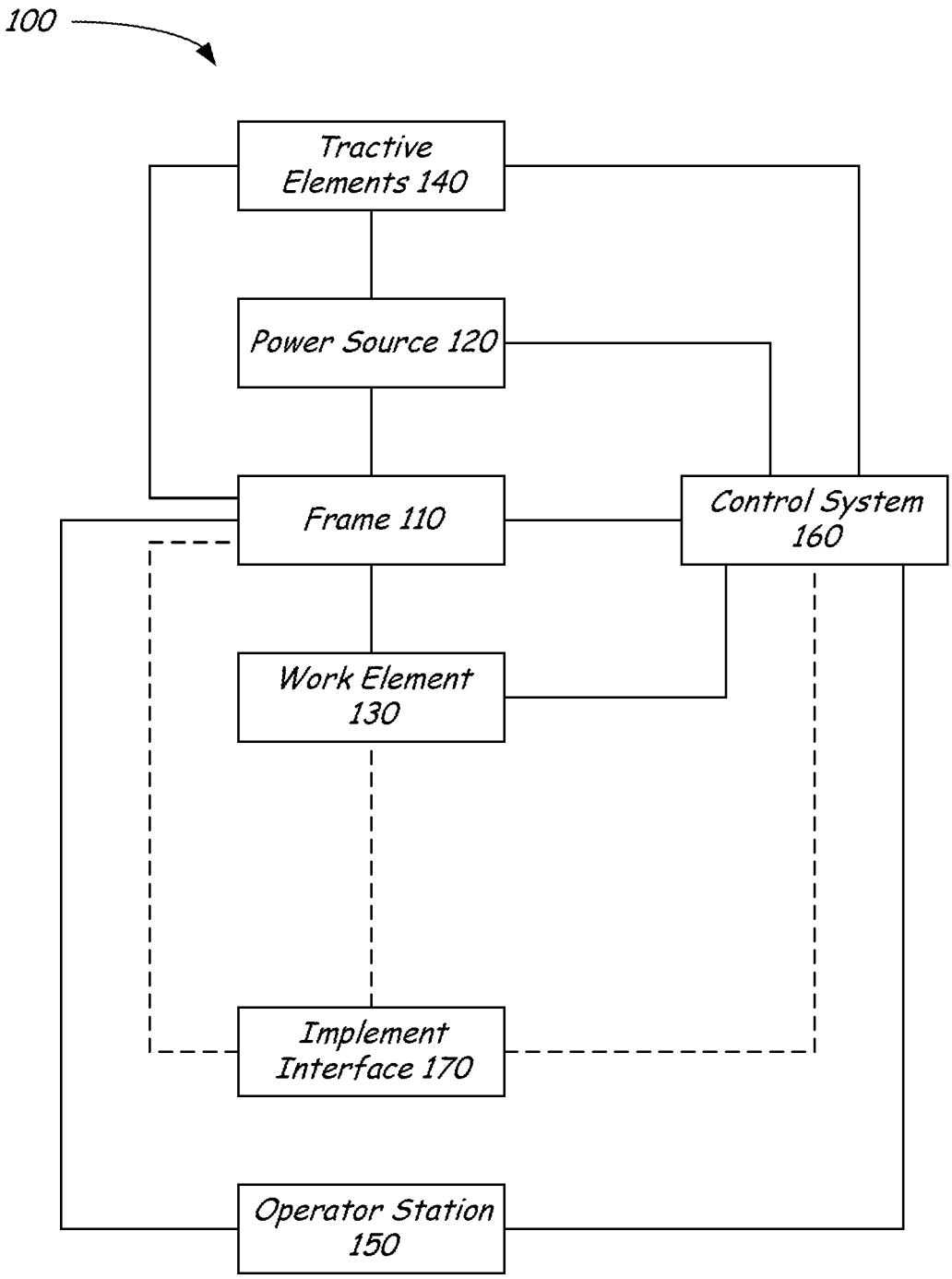
FIG. 1 is a block diagram illustrating functional systems of a representative power machine on which embodiments of the present disclosure can be advantageously practiced.

The concepts disclosed in this discussion are described and illustrated by referring to exemplary embodiments. These concepts, however, are not limited in their application to the details of construction and the arrangement of components in the illustrative embodiments and are capable of being practiced or being carried out in various other ways. The terminology in this document is used for description and should not be regarded as limiting. Words such as "including," "comprising," and "having" and variations thereof as used herein are meant to encompass the items listed thereafter, equivalents thereof, as well as additional items.

As used herein in the context of a power machine, unless otherwise defined or limited, the term "lateral" refers to a direction that extends at least partly to a left or a right side of a front-to-back reference line defined by the power machine. Accordingly, for example, a lateral side wall of a cab of a power machine can be a left side wall or a right side wall of the cab, relative to a frame of reference of an operator who is within the cab or is otherwise oriented to operatively engage with controls of an operator station of the cab.

Some discussion below describes improved arrangements for hydraulic sub-assemblies of power machines, including sub-assemblies with support panels that have various hydraulic components mounted directly and indirectly thereto and that can be mounted to a frame of a power machine to secure the entire relevant sub-assembly to the power machine. Some embodiments can provide substantial improvements over conventional hydraulic sub-assemblies and related manufacturing methods. For example, securing relevant hydraulic components in a particular arrangement on a support panel, to form hydraulic sub-assembly before assembling the hydraulic sub-assembly onto a power machine, can reduce the time to complete a production build of the power machine, improve quality assurance, reduce inventory costs, and reduce the labor and overhead necessary to complete assembly of the power machine.

In some embodiments, a plurality of components can be secured to a support panel to be supported by the support panel relative to a cab of a power machine, such as a cab of a loader. Further, in some embodiments, one or more components of a sub-assembly can be secured in particular locations and orientations relative to other components of the sub-assembly or other related structures, such as on an opposite side of a support panel from various other components or in a particular location relative to an operator station of a power machine. This can be useful, for example, to help to account for various design constraints of different power machines and to improve operator experience during operation of the power machine.

In some embodiments, a plurality of hydraulic components for can be secured to a support panel, and the support panel can be installed as a structural portion of a power machine. For example, a plurality of hydraulic components for control of a power machine can be secured to a support panel that can then be installed as a structural side wall of a cab of the power machine. Thus, installation of the support panel can provide structural integrity for a portion of the cab while also appropriately orienting the hydraulic components for operation of the power machine. In this regard, some embodiments can include a support panel that provides a rigid side wall of a cab, while also disposing operator input devices to be easily accessible by an operator within the cab and at least partly isolating the operator from noise, vibration, leaks, or other potential effects of the operation of other components supported by the support panel.

As used herein, "structural portion" generally refers to a component of a larger structure or assembly that provides a substantial (e.g., majority) portion of the structural strength of an associated part of the larger structure or assembly. Accordingly, for example, a rigid metal side panel that forms a wall of a cab may generally be a structural portion of the cab, whereas a plastic or otherwise primarily ornamental cover for such a wall may generally not be a structural portion of the cab.

Figure 2:
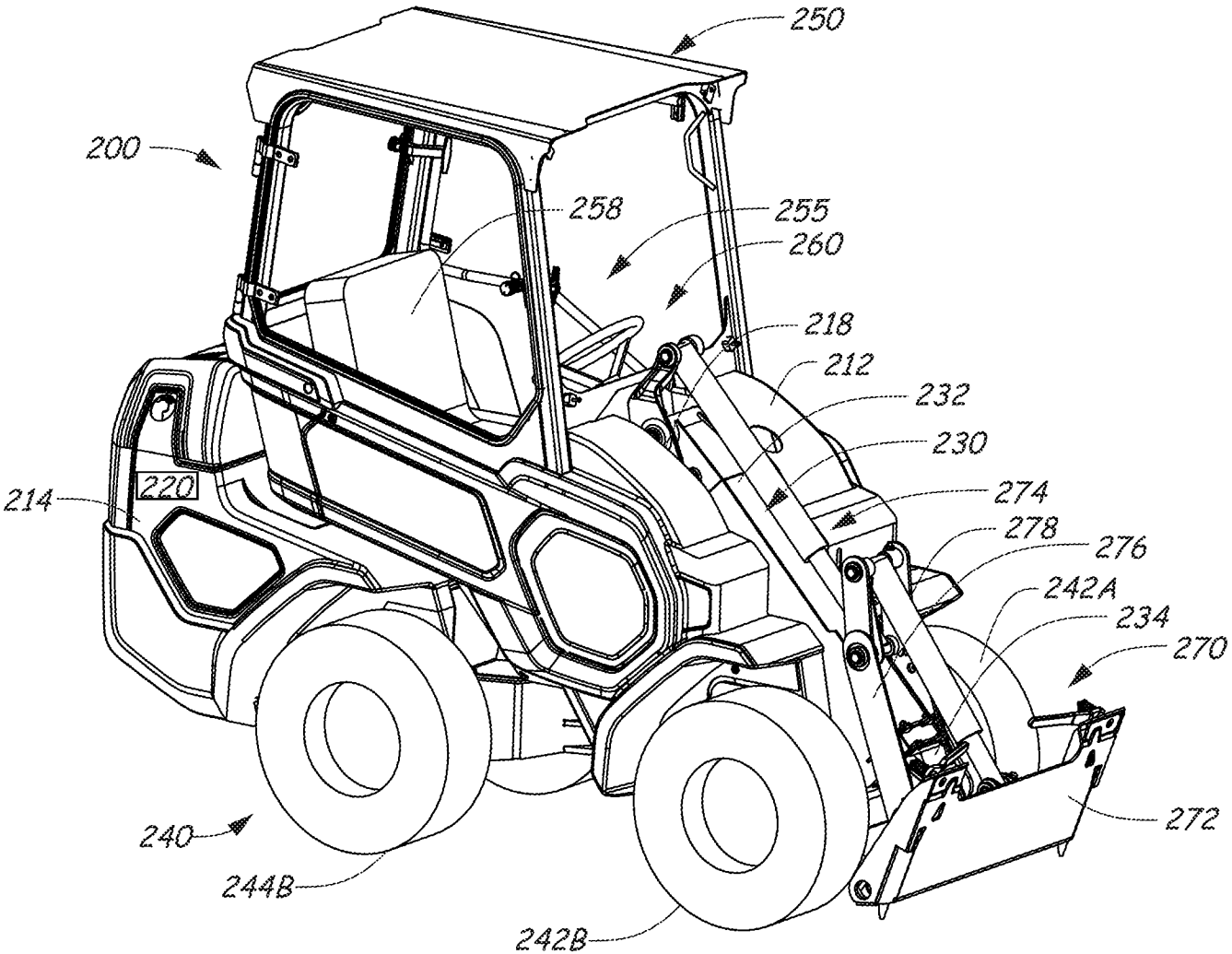
FIG. 2 is a perspective view showing generally a front of a power machine in the form of a small articulated loader on which embodiments disclosed in this specification can be advantageously practiced.
Figure 3:
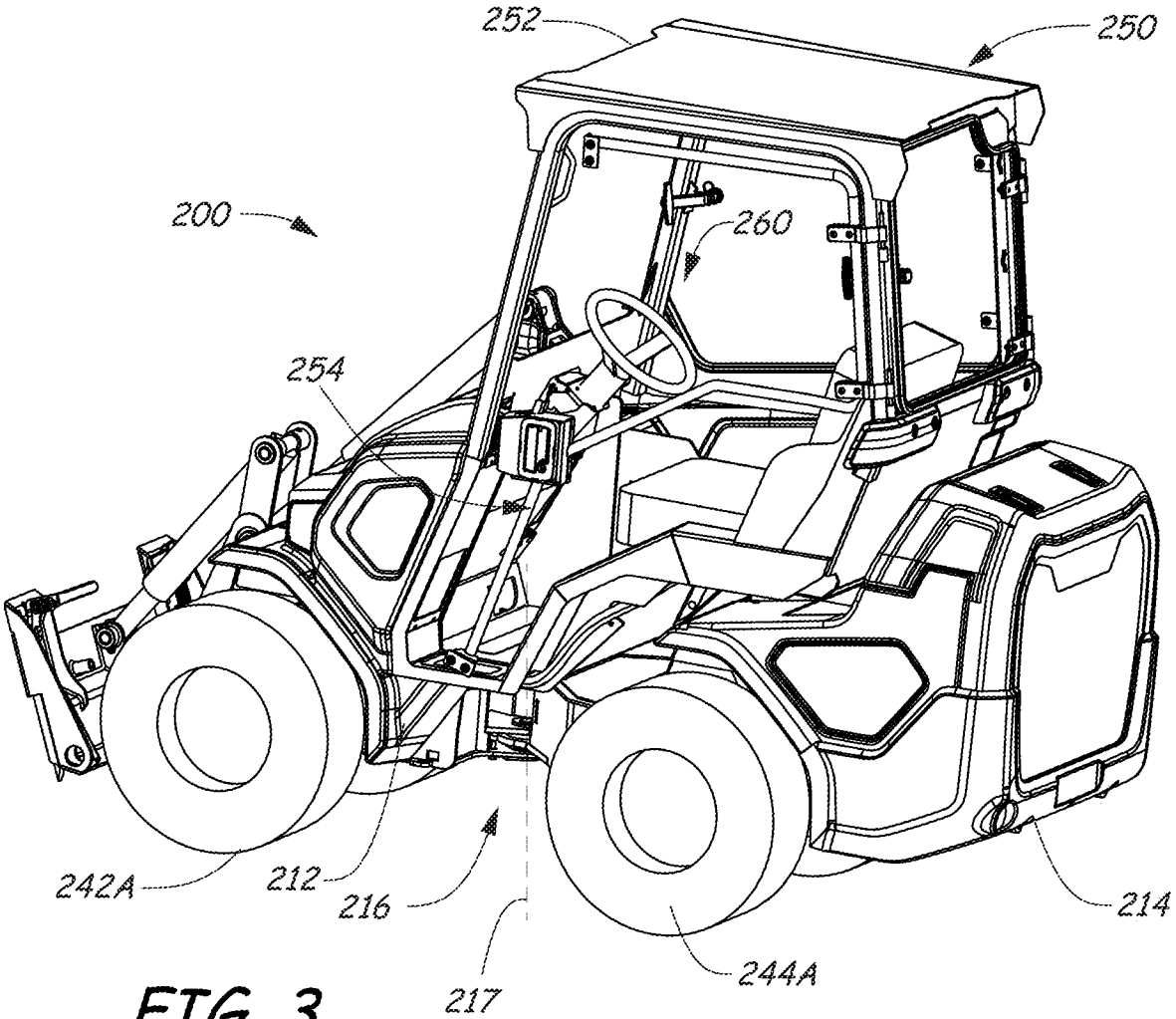
FIG. 3 is a perspective view showing generally a back of the power machine shown in FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is discussed. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

Some embodiments of the disclosure are presented below in the context of articulated loaders, with hydraulic sub-assemblies and other relevant components arranged on and secured to pivotable front frames of the articulated loaders. In some embodiments, hydraulic sub-assemblies according to the disclosure can be used with other types of power machines, including with other articulated power machines and with non-articulated power machines.

In addition, some embodiments of the disclosure are presented in the context of a hydraulic sub-assembly for controlling work functions, such as by controlling work actuators to maneuver one or more implements. In some embodiments, hydraulic sub-assemblies according to the disclosure can also be configured for other uses, such as to control other features, actuations, or movements of power machines.

FIG. 1 is a block diagram that illustrates the basic systems of a power machine 100 upon which the embodiments discussed below can be advantageously incorporated and can be any of a number of different types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm can be manipulated to position the implement to perform the task. In some instances, the implement can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of different implements to the work element. One characteristic of such an implement carrier is that once an implement is attached to it, the implement carrier is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work elements with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which can provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that can convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether they have operator compartments, operator positions or neither, may be capable of being operated remotely (i.e. from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e. remote from both the power machine and any implement to which is it coupled) that is capable of controlling at least some of the operator-controlled functions on the power machine.

FIGS. 2-3 illustrate a loader 200, which is one particular example of a power machine of the type illustrated in FIG. 1 where the embodiments discussed below can be advantageously employed. Loader 200 is an articulated loader with a front mounted lift arm assembly 230, which in this example is a telescopic lift arm. Loader 200 is one particular example of the power machine 100 illustrated broadly in FIG. 1 and discussed above. To that end, features of loader 200 described below include reference numbers that are generally similar to those used in FIG. 1. For example, loader 200 is described as having a frame 210, just as power machine 100 has a frame 110. The description herein of loader 200 with references to FIGS. 2-3 provides an illustration of the environment in which the embodiments discussed below can be practiced and this description should not be considered limiting especially as to the description of features that loader 200 that are not essential to the disclosed embodiments. Such features may or may not be included in power machines other than loader 200 upon which the embodiments disclosed below may be advantageously practiced. Unless specifically noted otherwise, embodiments disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

Loader 200 includes frame 210 that supports a power system 220 that can generate or otherwise provide power for operating various functions on the power machine. Frame 210 also supports a work element in the form of lift arm assembly 230 that is powered by the power system 220 and that can perform various work tasks. As loader 200 is a work vehicle, frame 210 also supports a traction system 240, which is also powered by power system 220 and can propel the power machine over a support surface. The lift arm assembly 230 in turn supports an implement interface 270 that includes an implement carrier 272 that can receive and secure various implements to the loader 200 for performing various work tasks and power couplers 274, to which an implement can be coupled for selectively providing power to an implement that might be connected to the loader. Power couplers 274 can provide sources of hydraulic or electric power or both. The loader 200 includes a cab 250 that defines an operator station 255 from which an operator can manipulate various control devices to cause the power machine to perform various work functions. Cab 250 includes a canopy 252 that provides a roof for the operator compartment and is configured to have an entry 254 on one side of the seat (in the example shown in FIG. 3, the left side) to allow for an operator to enter and exit the cab 250.

Although cab 250 as shown does not include any windows or doors, a door or windows can be provided.

The operator station 255 includes an operator seat 258 and the various operation input devices 260, including control levers that an operator can manipulate to control various machine functions. Operator input devices can include a steering wheel, buttons, switches, levers, sliders, pedals and the like that can be stand-alone devices such as hand operated levers or foot pedals or incorporated into hand grips or display panels, including programmable input devices. Actuation of operator input devices can generate signals in the form of electrical signals, hydraulic signals, and/or mechanical signals. Signals generated in response to operator input devices are provided to various components on the power machine for controlling various functions on the power machine. Among the functions that are controlled via operator input devices on power machine 100 include control of the tractive system 240, the lift arm assembly 230, the implement carrier 272, and providing signals to any implement that may be operably coupled to the implement.

Loaders can include human-machine interfaces including display devices that are provided in the cab 250 to give indications of information relatable to the operation of the power machines in a form that can be sensed by an operator, such as, for example, audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to providing dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such as walk behind loaders may not have a cab nor an operator compartment, nor a seat. The operator position on such loaders is generally defined relative to a position where an operator is best suited to manipulate operator input devices.

Various power machines that can include and/or interact with the embodiments discussed below can have various different frame components that support various work elements. The elements of frame 210 discussed herein are provided for illustrative purposes and should not be considered to be the only type of frame that a power machine on which the embodiments can be practiced can employ. As mentioned above, loader 200 is an articulated loader and as such has two frame members that are pivotally coupled together at an articulation joint. For the purposes of this document, frame 210 refers to the entire frame of the loader. Frame 210 of loader 200 includes a front frame member 212 and a rear frame member 214. The front and rear frame members 212, 214 are coupled together at an articulation joint 216. Actuators (not shown) are provided to rotate the front and rear frame members 212, 214 relative to each other about an axis 217 to accomplish a turn.

The front frame member 212 supports and is operably coupled to the lift arm 230 at joint 216. A lift arm cylinder (not shown, positioned beneath the lift arm 230) is coupled to the front frame member 212 and the lift arm 230 and is operable to raise and lower the lift arm under power. The front frame member 212 also supports front wheels 242A and 242B. Front wheels 242A and 242B are mounted to rigid axles (the axles do not pivot with respect to the front frame member 212). The cab 250 is also supported by the front frame member 212 so that when the front frame member 212 articulates with respect to the rear frame member 214, the cab 250 moves with the front frame member 212 so that it will swing out to either side relative to the rear frame member 214, depending on which way the loader 200 is being steered.

The rear frame member 214 supports various components of the power system 220 including an internal combustion engine. In addition, one or more hydraulic pumps are coupled to the engine and supported by the rear frame member 214. The hydraulic pumps are part of a power conversion system to convert power from the engine into a form that can be used by actuators (such as cylinders and drive motors) on the loader 200. Power system 220 is discussed in more detail below. In addition, rear wheels 244A and 244B are mounted to rigid axles that are in turn mounted to the rear frame member 214. When the loader 200 is pointed in a straight direction (i.e., the front frame portion 212 is aligned with the rear frame portion 214), a portion of the cab is positioned over the rear frame portion 214.

The lift arm assembly 230 shown in FIGS. 2-3 is one example of many different types of lift arm assemblies that can be attached to a power machine such as loader 200 or other power machines on which embodiments of the present discussion can be practiced. The lift arm assembly 230 is a radial lift arm assembly, in that the lift arm is mounted to the frame 210 at one end of the lift arm assembly and pivots about the mounting joint 216 as it is raised and lowered. The lift arm assembly 230 is also a telescoping lift arm. The lift arm assembly includes a boom 232 that is pivotally mounted to the front frame member 212 at joint 216. A telescoping member 234 is slidably inserted into the boom 232 and telescoping cylinder (not shown) is coupled to the boom and the telescoping member and is operable to extend and retract the telescoping member under power. The telescoping member 234 is shown in FIGS. 2 and 3 in a fully retracted position. The implement interface 270 including implement carrier 272 and power couplers 274 are operably coupled to the telescoping member 234. An implement carrier mounting structure 276 is mounted to the telescoping member. The implement carrier 272 and the power couplers 274 are mounted to the positioning structure. A tilt cylinder 278 is pivotally mounted to both the implement carrier mounting structure 276 and the implement carrier 272 and is operable to rotate the implement carrier with respect to the implement carrier mounting structure under power. Among the operator controls 260 in the operator station 255 are operator controls to allow an operator to control the lift, telescoping, and tilt functions of the lift arm assembly 230.

Other lift arm assemblies can have different geometries and can be coupled to the frame of a loader in various ways to provide lift paths that differ from the radial path of lift arm assembly 230. For example, some lift paths on other loaders provide a radial lift path. Others have multiple lift arms coupled together to operate as a lift arm assembly. Still other lift arm assemblies do not have a telescoping member. Others have multiple segments. Unless specifically stated otherwise, none of the inventive concepts set forth in this discussion are limited by the type or number of lift arm assemblies that are coupled to a particular power machine.

Figure 4:
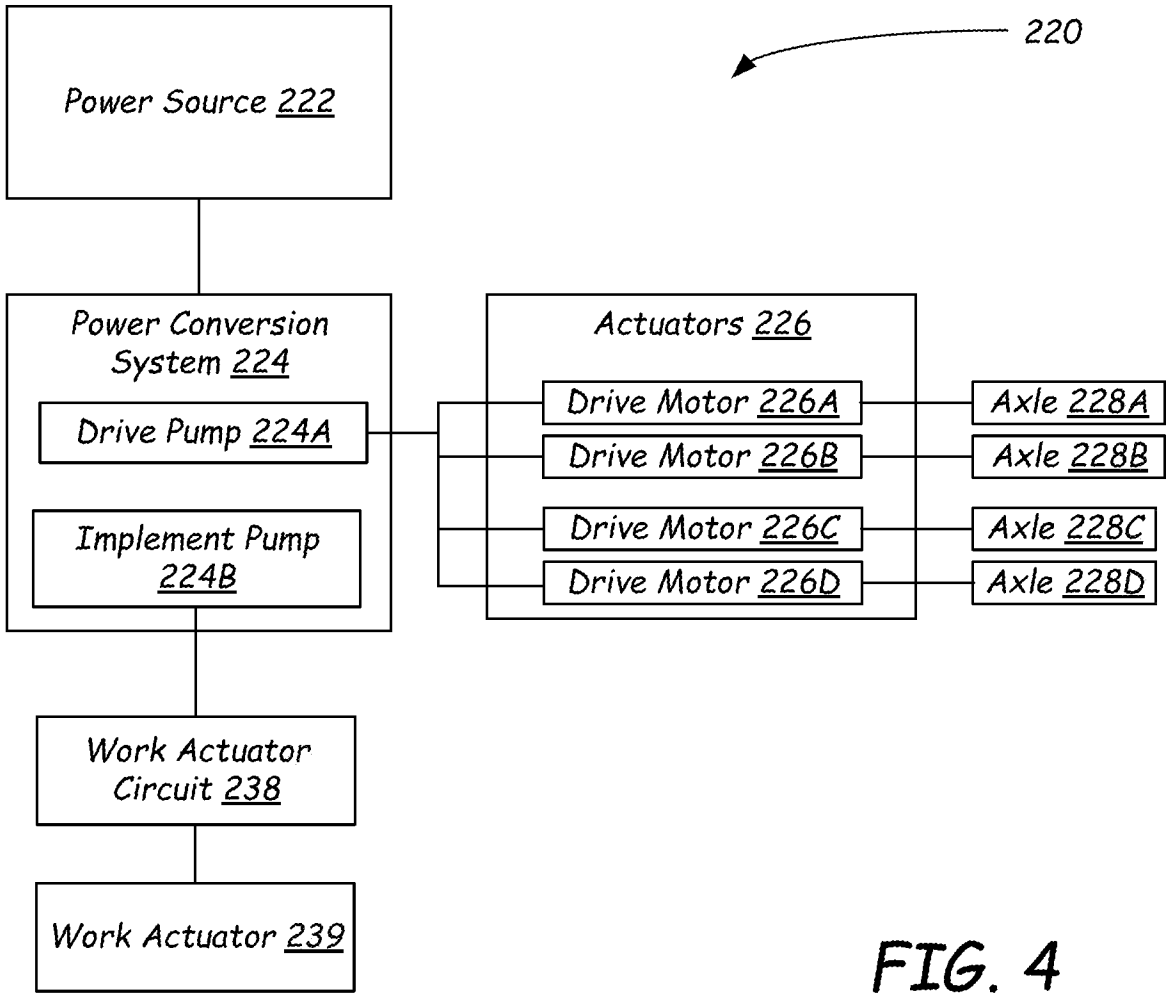
FIG. 4 is a block diagram illustrating components of a hydraulic power system of a loader such as the loader of FIGS. 2 and 3.

FIG. 4 illustrates power system 220 in more detail. Broadly speaking, power system 220 includes one or more power sources 222 that can generate and/or store power for operating various machine functions. On loader 200, the power system 220 includes an internal combustion engine.

Other power machines can include electric generators, rechargeable batteries, various other power sources or any combination of power sources that can provide power for given power machine components. The power system 220 also includes a power conversion system 224, which is operably coupled to the power source 222. Power conversion system 224 is, in turn, coupled to one or more actuators 226, which can perform a function on the power machine. Power conversion systems in various power machines can include various components, including mechanical transmissions, hydraulic systems, and the like. The power conversion system 224 of power machine 200 includes a hydrostatic drive pump 224A, which provides a power signal to drive motors 226A, 226B, 226C and 226D. The four drive motors 226A, 226B, 226C and 226D in turn are each operably coupled to four axles, 228A, 228B, 228C and 228D, respectively. Although not shown, the four axles are coupled to the wheels 242A, 242B, 244A, and 244B, respectively. The hydrostatic drive pump 224A can be mechanically, hydraulically, and/or electrically coupled to operator input devices to receive actuation signals for controlling the drive pump. The power conversion system also includes an implement pump 224B, which is also driven by the power source 222. The implement pump 224B is configured to provide pressurized hydraulic fluid to a work actuator circuit 238. Work actuator circuit 238 is in communication with work actuator 239. Work actuator 239 is representative of a plurality of actuators, including the lift cylinder, tilt cylinder, telescoping cylinder, and the like. The work actuator circuit 238 can include valves and other devices to selectively provide pressurized hydraulic fluid to the various work actuators represented by block 239 in FIG. 4. In addition, the work actuator circuit 238 can be configured to provide pressurized hydraulic fluid to work actuators on an attached implement.

The description of power machine 100 and loader 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on a loader such as track loader 200, unless otherwise noted or recited, the concepts discussed below are not intended to be limited in their application to the environments specifically described above.

Figure 5:
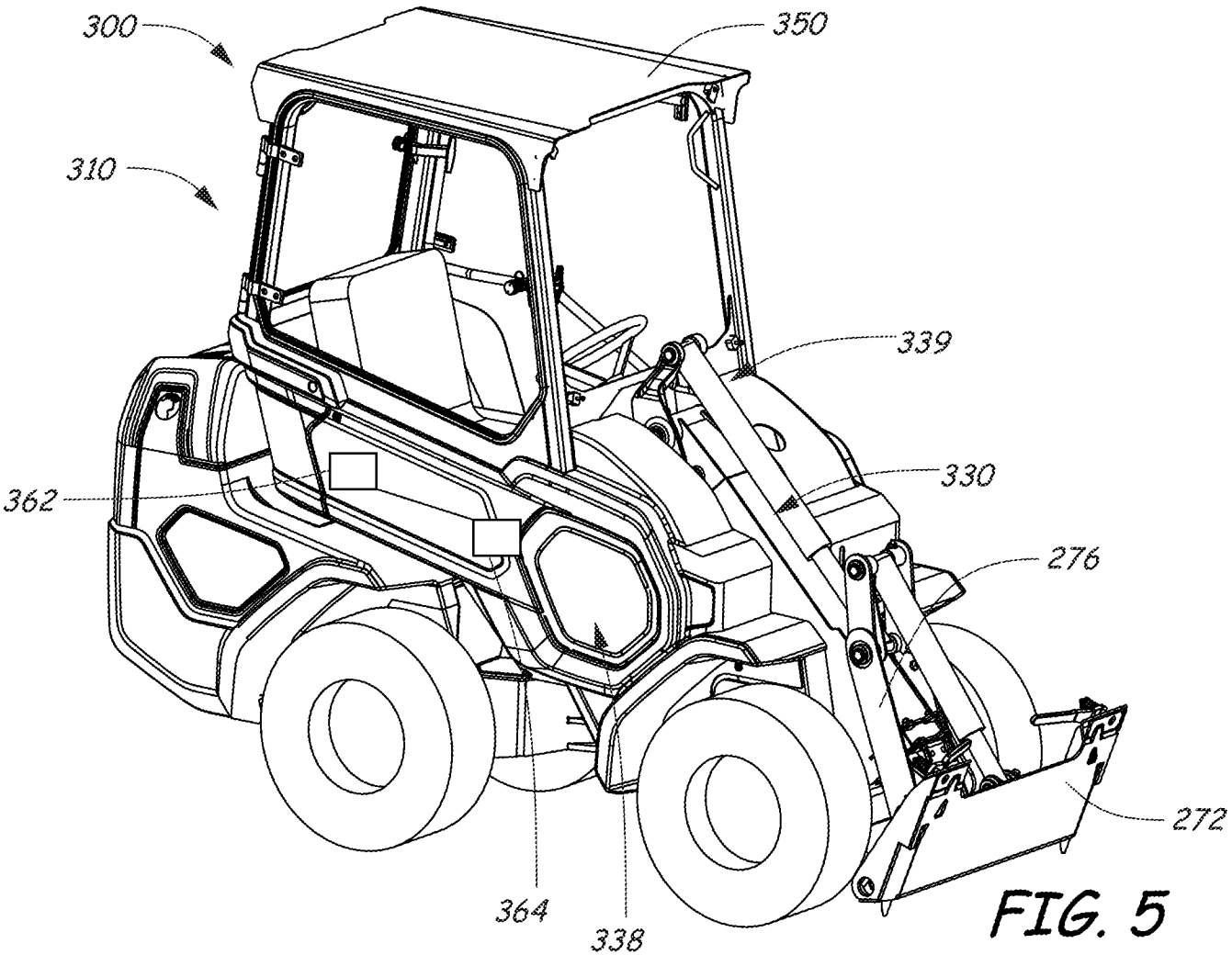
FIG. 5 is a perspective view showing generally a front of a power machine in the form of a compact loader on which embodiments disclosed in this specification can be advantageously practiced, with a hydraulic actuator circuit.

FIG. 5 illustrates an example of a loader 300, which is one particular example of the power machine 100 illustrated broadly in FIG. 1 and discussed above, and relative to which the embodiments discussed herein can be advantageously employed. The loader 300 is similar in some ways to the loader 200 described above and like numbers represent similar parts. For example, like the loader 200, the loader 300 includes an articulated frame 310, a lift arm assembly 330, a work actuator circuit 338, a work actuator 339, and an operator enclosure that is at least partly defined by a cab 350.

Certain components of the work actuator circuit 338 are shown schematically in FIG. 5, superimposed over the loader 300 to represent potential mounting locations for the components on the loader 300. Among other components, for example, the work actuator circuit 338 includes a pilot valve 362 and a control valve 364 to collectively control the routing of pressurized hydraulic fluid to the one or more work actuators 339, such as one or more hydraulic cylinders configured to move the lift arm assembly 330. In some arrangements, the work actuator circuit 338 can include other valves and other devices to selectively provide pressurized hydraulic fluid to the various work actuators 339 or other hydraulic components.

In conventional arrangements, the pilot valve 362 and control valve 364 may be individually installed on the loader 300, which may result in certain inefficiencies. For example, the need to individually position the pilot valve 362 and the control valve 364 on the loader 300 may result in increased manufacturing time and costs as well as more burdensome quality control. Individual attachment of each of multiple components of the work actuator circuit 338 to the loader 300 may also increase design constraints for the loader 300 as a whole, including because multiple components of the loader, such as the frame 310, may accordingly need to include multiple, dispersed reinforcement or attachment points to support the components of the work actuator circuit 338. In addition, due to the dispersed arrangement of the relevant components of the work actuator circuit 338, and the large number and lengths of tube lines and flexible hoses that can be required, access to and management of the conventional work actuator circuit 338 for maintenance or other tasks can be difficult.

Embodiments of the disclosure can address one or more of the issues noted above, or others. For example, some embodiments of the invention can include a support panel to which are attached multiple components (e.g., a pilot valve, a control valve, etc.) of a work actuator circuit. As also alluded to above, this can help to expedite installation, removal, and maintenance of the work actuator circuit, which may decrease manufacturing and maintenance time and costs. For example, attachment of multiple components to a single support panel before the support panel is attached to a frame of a power machine can simplify and accelerate manufacture of the power machine, including due to the improved ease of assembling large or complex portions of hydraulic circuits prior to installation of the circuit portions (or the circuits as a whole) on the power machine frame. Additionally, use of a support panel to attach multiple components to a power machine can result in a more robust arrangement for support of the multiple components, which can lead to improved overall durability and reduced maintenance load for the power machine, including simplified replacement of entire hydraulic circuits (or multi-component portions thereof).

Figure 6:
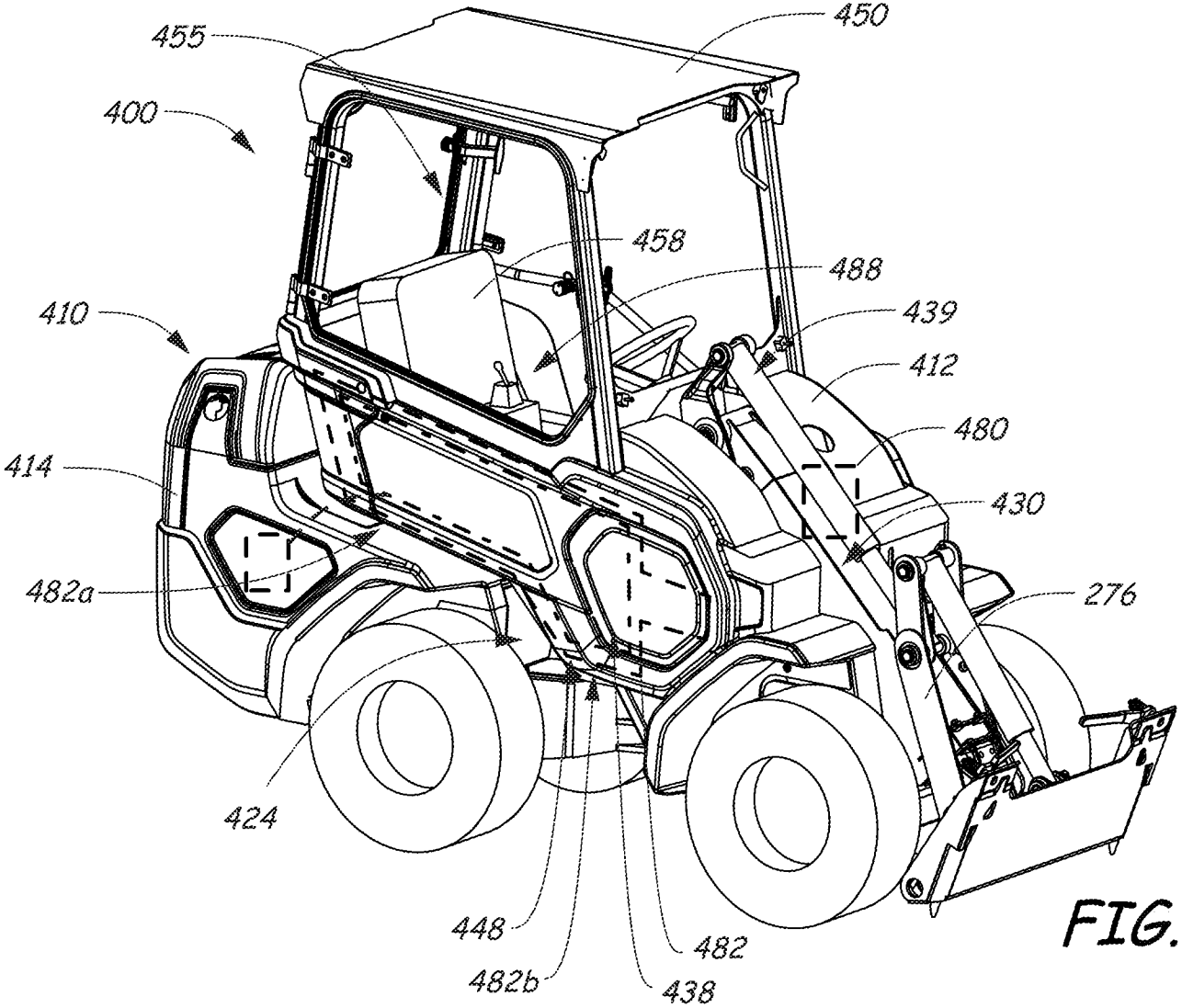
FIG. 6 is a perspective view showing generally a front of a power machine in the form of a compact loader on which embodiments disclosed in this specification can be advantageously practiced, with a hydraulic sub-assembly according to embodiments of the disclosure.

FIG. 6 illustrates a loader 400 on which the embodiments discussed herein can be advantageously employed. The loader 400 is one particular example of the power machine 100 illustrated broadly in FIG. 1 and discussed above in reference to FIGS. 1-4. The loader 400 is similar in some ways to the loaders 200, 300 described above, with like numbers representing similar parts. For example, the loader 400 includes an articulated frame 410, a lift arm assembly 430, a work actuator circuit 438, a cab 450 that at least partly defines an operator station 455, and one or more work actuators 439 that may help to operate the lift arm assembly 430 or other devices.

To allow the loader 400 to execute various operations, the frame 410 includes a front frame member 412 that supports the cab 450 and is coupled at an articulation joint (not shown in FIG. 6) to a rear frame member 414. This arrangement allows the front of the loader 400, including the cab 450, to pivot relative to the rear of the loader 400, via the articulation joint. In other embodiments, different relative sizes of the front and rear of the loader 400 and other different configurations are possible, including configurations with different proportions of the cab 450 extending forward or rearward of the articulation joint or otherwise positioned relative to the front and rear frame members 412, 414 of the loader 400, configurations with differently shaped or sized cabs, different types of operator stations or control devices, and so on.

Various configurations are possible for a work actuator circuit of the loader 400, depending on the work functions to be performed (e.g., operation of the work actuators 439 in different ways to control an implement (not shown)). For example, the work actuator circuit 438 is fluidly coupled with a tank 480 that is configured to hold a supply of pressurized hydraulic fluid. The pressurized hydraulic fluid may include, for example, a dedicated hydraulic oil, an engine lubrication oil, a transmission lubrication oil, and the like. One or more pumps 424 are configured to draw fluid from and return fluid to the tank 480 to allow operation of one or more hydraulic components within the work actuator circuit 438.

To facilitate improved installation, operation, and maintenance relative to conventional systems, multiple components of the work actuator circuit 438 are combined in a hydraulic sub-assembly 448, which can be assembled remotely from the loader 400 and installed on the loader 400, once assembled, as an integrated unit. Once the hydraulic sub-assembly 448 has been installed on the loader and appropriately integrated with other components of the work actuator circuit 438 or other hydraulic systems (e.g., by connection of appropriate hydraulic conduits), pressurized hydraulic fluid can be delivered from the tank 480, or elsewhere, to a plurality of components included on the hydraulic sub-assembly 448, such as control or pilot valves, hydraulic coolers, operator input devices (e.g., joysticks), and so on.

Figure 7:
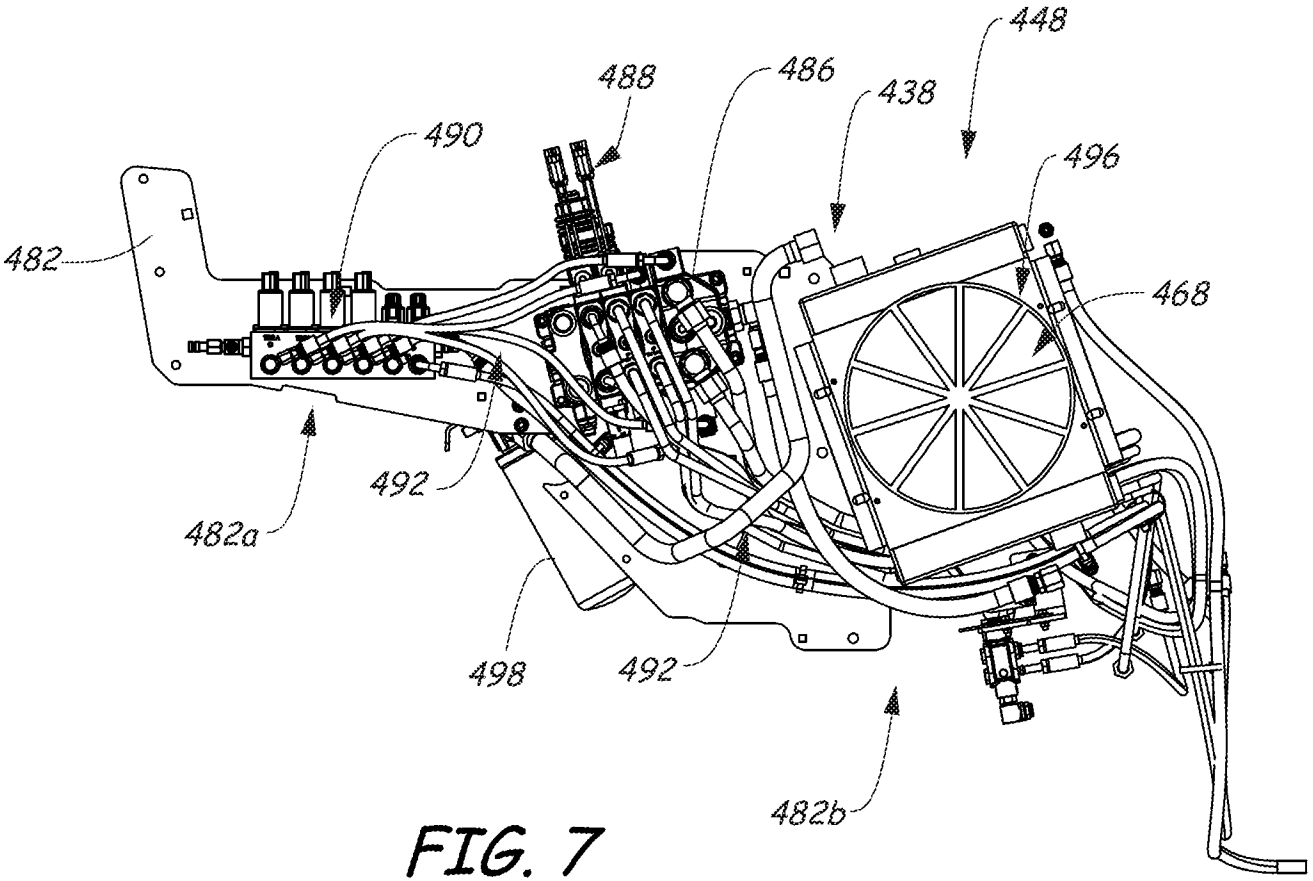
FIG. 7 is a side elevation view of a first side of a hydraulic sub-assembly according to embodiments of the disclosure.
Figure 8:
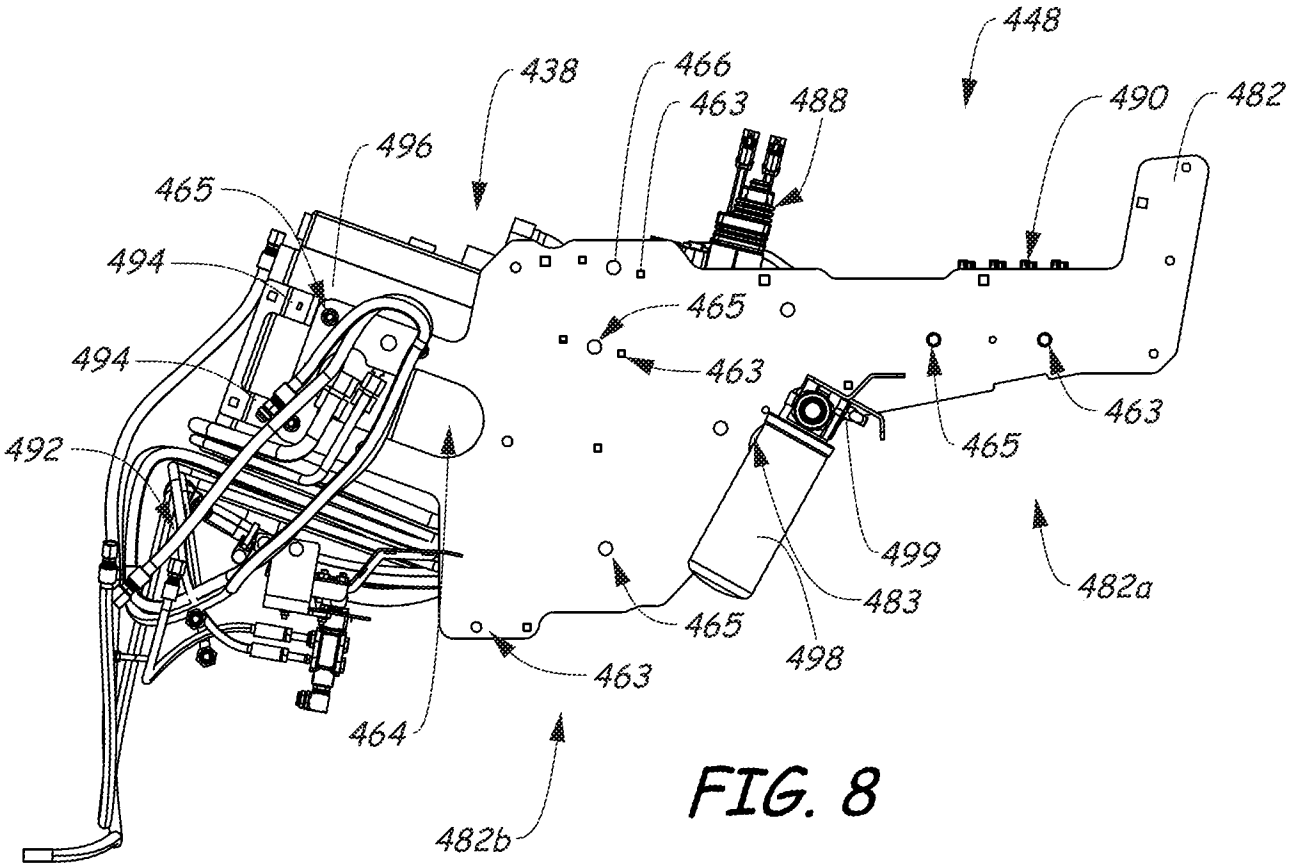
FIG. 8 is a side elevation view of a second side of the hydraulic sub-assembly of FIG. 7 according to embodiments of the disclosure.
Figure 9:
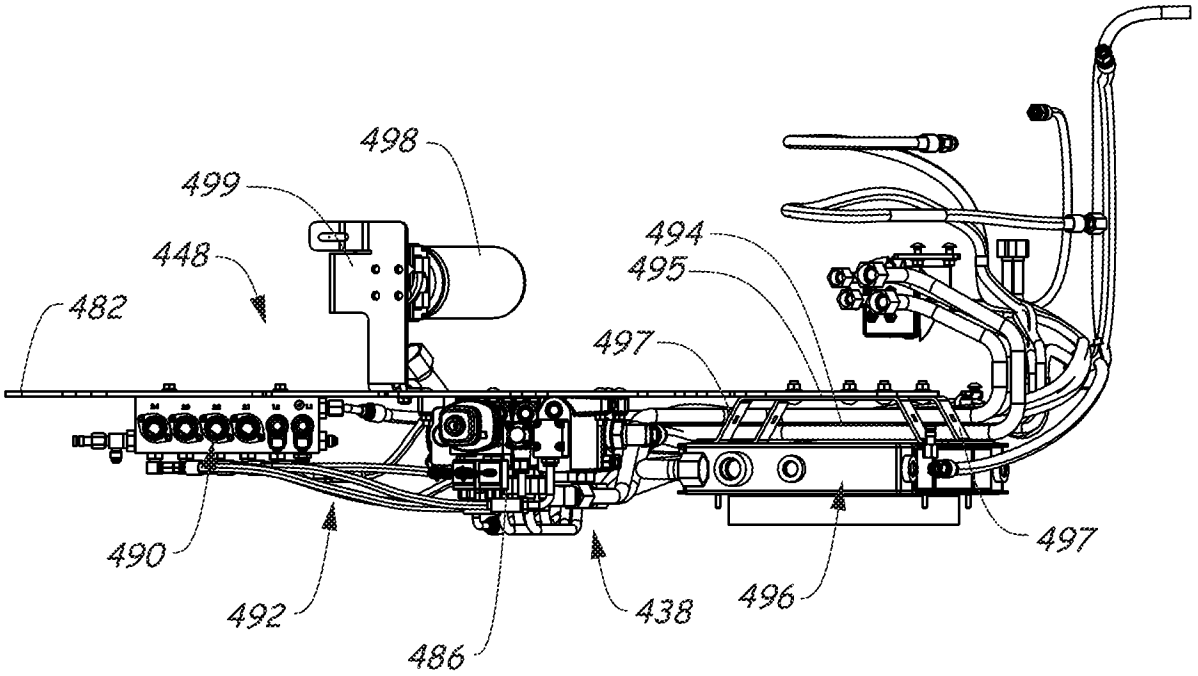
FIG. 9 is a top plan view of the hydraulic sub-assembly of FIG. 7 according to embodiments of the disclosure.

In some embodiments, a hydraulic sub-assembly can include a support panel that can support multiple hydraulic components of the hydraulic sub-assembly and that can be secured to a frame of a loader to support the multiple hydraulic components relative to the frame. The hydraulic sub-assembly 448, for example, as also shown in FIGS. 7-9, includes a support panel 482 that is configured to be positioned along and mounted to the cab 450, to at least partially form a sidewall of the cab 450, another portion of the cab 450, or another relevant structural portion of the loader 400. A trim panel 484 can be positioned over the support panel 482 such that the support panel 482 is concealed between the operator station 455 and the trim panel 484 in an assembled state.

In some embodiments, a hydraulic sub-assembly or components thereof can exhibit geometries that conform with (i.e., are substantially geometrically similar to) parts of a loader to which the sub-assembly is attached. In the embodiment illustrated in FIG. 6, because the support panel 482 forms part of the cab 450, the support panel 482 is configured to pivot with the front of the loader 400, relative to the rear of the loader 400, via movement of the articulation joint. Accordingly, it can be useful for the trim panel 484, the support panel 482, and the hydraulic sub-assembly 448 generally, to exhibit a generally complementary geometry to a portion of the side of the cab 450. In this regard, the support panel 482 includes a narrow, elongate rear portion 482*a* and a wide, downwardly extending front portion 482*b*, with the rear portion 482*a* generally also forming an upper, extended portion of a dog-leg profile of the support panel 482. Similarly, the hydraulic sub-assembly 448 as a whole generally exhibits a narrower, elongate rear portion and a wider, downwardly extending front portion.

When the support panel 482 is secured to the cab 450, forming in particular a structural lateral side wall of the cab 450 in the illustrated embodiment, the rear portion 482*a* extends rearward along the side of the cab 450, to be disposed vertically over a portion of the rear frame member 414, and the one or more pumps 424. Due in part to this narrower rear geometry, the rear portion 482*a* of the support panel 482, and the hydraulic sub-assembly 448 generally, can pivot with the other structures of the cab 450 along paths of travel that extend above parts of the rear frame member 414 (e.g., above the rear wheels of the loader 400).

Although the front portion 482*b* also pivots with the other structures of cab 450 and the front frame portion 412, in the illustrated embodiment it does not move to extend substantially over the rear frame member 414. Thus, similarly to the cab 450 generally, the front portion 482*b* of the support panel 482 exhibits a vertically wider, downwardly extending geometry (relative to the rear portion 482*a*), and can accordingly be used to support relatively large components or multiple components of the hydraulic sub-assembly 448. Correspondingly, the front portion 482*b* can also provide coverage and structural support for a substantial portion of a lateral side of the cab 450, including a majority of a front-to-back depth of the lateral side area of the cab 450 or the operator station 455, and a majority of the bottom-to-top height of the cab 450 or the operator station 455 below the lateral side window.

Although the geometry of the support panel 482 and the geometry of the hydraulic sub-assembly 448 generally form a portion of a side wall of the cab 450 and accordingly exhibit a similar geometry as part of the larger profile of the cab 450, other configurations are also possible. For example, some hydraulic sub-assemblies can exhibit other profiles, including profiles that are substantially similar to other parts of a power machine (e.g., other parts of a cab, a front frame of an articulated loader, or a rear frame of an articulated loader). In some embodiments, a cab may be secured to a rear frame member of a power machine and the front frame member of the power machine may pivot relative to the support panel. Correspondingly, a support panel of a hydraulic sub-assembly (e.g., similar to the panel 482) can be secured to the rear frame member, including via attachment of the support panel to the cab. In some embodiments, a support panel of a sub-assembly can be secured to a different side of a cab than is shown in FIG. 6 for the cab 450.

In some embodiments, some components of a hydraulic sub-assembly can be fully contained within a perimeter of a support panel that secures the components to a cab of a power machine. For example, as also discussed below, a control valve 486 and a pilot valve 490 are secured to the support panel 482 on an opposite side of the panel 482 from the operator station 455 and fully within the laterally projected perimeter of the panel 482. Accordingly, the control valve 486 and the pilot valve 490 may be fully shielded, in a lateral direction, relative to the operator station 455. However, in some embodiments, part or all of the hydraulic or other components of a hydraulic sub-assembly, such as components of a work actuator circuit, may extend partly or fully outside of a perimeter of a relevant support panel.

A support panel can be configured as a unitary body or as multiple bodies that are secured together, depending on the needs of a particular power machine, the necessary or desired constraints on an installation method for the support panel (and the hydraulic sub-assembly as a whole), the size and other aspects of a structural portion of a cab that is defined by the support panel, or other factors. In the example configuration shown in FIG. 7, the support panel 482 is a rigid unitary (i.e., single-piece) body, as can be formed from a stamped sheet metal blank, or through molding, casting, or otherwise. When stamped from an appropriate gauge of sheet metal, for example, the support panel 482 may exhibit significant durability and reliability, including as can allow the support panel 482 to provide a structural portion of a cab, and can be readily manufactured at relatively low cost, using known techniques. However, other materials and manufacturing techniques are possible. In some embodiments, a support panel can be formed from multiple sheet-metal or other components that are secured together using fasteners, welding, adhesives, or other techniques.

As also discussed above, a support panel of a hydraulic sub-assembly can be used to support multiple hydraulic and other components, for unified installation on a power machine. In different embodiments, different numbers and types of components can be included in a hydraulic sub-assembly and secured to a support panel. For example, support panels for some hydraulic-sub-assemblies can be configured to support hydraulic components including operator input devices (e.g., hydraulically operated joysticks), control valves, pilot valves, coolers, filters, conduits, fittings, and so on, any number of which can be secured to the support panel before the support panel is installed on the relevant power machine. In some embodiments, some components can be secured together or hydraulically connected with each other before or after being secured to a support panel. In some embodiments, some components can be secured to a support panel indirectly, while still being configured to be supported relative to a power machine frame by the support panel, including by being directly secured to other components that are in turn secured, directly or indirectly, to the support panel.

As shown in FIGS. 7 and 8, in particular, a plurality of components for the work actuator circuit 438 are secured to and supported by the support panel 482. In particular, in the illustrated embodiment, components secured to the support panel 482 as part of the hydraulic sub-assembly 448 include: the control valve 486 for operation of work functions (e.g., via control of one or more work actuators 439 (see FIG. 6)); an operator input device 488 configured as a hydraulic joystick; the pilot valve 490 to facilitate interoperation of the control valve 486 and the operator input device 488; multiple hydraulic conduits 492, including multiple flexible hoses and multiple rigid tube lines; a set of cooler brackets 494 (see FIG. 8); a hydraulic cooler 496 secured to support panel 482 via the cooler brackets 494; and a hydraulic filter 498 secured to the support panel via a filter bracket 499. Collectively, these components (and others) can form part of the hydraulic sub-assembly 448 and, once appropriately installed, can control or interoperate with each other and other hydraulic components of a power machine (e.g., the loader 400), including for control of one or more work actuators or other components of the power machine. Further, because these components are collectively secured to and supported by the support panel 482, they can be initially configured and interconnected (in whole or in part) remotely from a loader, then can be collectively secured to the loader at any number of stages of manufacturing. In particular, the hydraulic assembly 448 is configured to be secured to the cab 450 (see FIG. 6), at a convenient manufacturing stage, with the support panel 482 forming a structural portion of the cab 450 to a lateral side of the operator station 455 (see FIGS. 6 and 11).

In this regard, for example, portions of the cab 450 can be formed separately from the support panel 482, such as via creation of a unitary weldment, and then the cab 450 can be completed at least partly by connecting the support panel 482 thereto. Components of a hydraulic sub-assembly, such as a support panel thereof, can be secured to a power machine in a variety of ways, including using welding, or rivets or other fasteners, depending on relevant design and manufacturing constraints for the support panel, for other components of the sub-assembly, or for a cab or other structure of the power machine.

Components of a hydraulic sub-assembly can be secured to a support panel in a variety of ways, depending on appropriate design and manufacturing constraints for the support panel, the components themselves, and the associated power machine in general. As shown in FIG. 8, for example, the support panel 482 includes multiple locating features 463 and fastener locations 465 for arranging components on and attaching the components to the support panel 482. For example, among other features, the front portion 482*b* of the support panel 482 defines a plurality of fastener locations 465, configured as bolt holes, for attaching the cooler bracket 494. Likewise, the rear portion 482*a* of the support panel 482 defines a plurality of fastener locations 465 for bolts for the pilot valve 490, and an intermediate portion of the support panel 482 defines fastener locations 465 for bolts for the control valve 486. The various locating features 463, configured in the illustrated example as square locating apertures, are also arranged around the support panel 482 in order to help locate various components for attachment to the support panel 482. In some embodiments, a locating feature can help to temporarily (e.g., non-rigidly) secure a component in an appropriate orientation for a bolt or other more permanent fastener to be installed.

In other embodiments, other configurations are possible, including configurations with differently arrayed, differently shaped, or otherwise modified fastener locations, different types of location features (e.g., dimples or other protrusions), and so on. For example, some hydraulic sub-assemblies can include fasteners that are integrally formed with or otherwise secured to a support panel prior to the attachment of components using those fasteners, including non-threaded (e.g., snap-in or snap-on) fasteners or others. As another example, some support panels can be formed with depressions, protrusions, or other features that are configured to help locate or secure certain components to the support panels.

Other features can also be provided. For example, the front portion 482*b* of the support panel 482 also defines an opening 464 that is substantially aligned with one side of the cooler 496. The opening 464 can provide a number of benefits, including reducing the overall material required for the support panel 482, helping to ensure adequate air flow to, from, or around the cooler 496, allowing access to fittings or other components (not shown) on the exposed side of the cooler 496 (e.g., for maintenance operations), allowing one or more of the conduits 492 to pass between opposing sides of the support panel 482, and so on.

As also noted above, the control valve 486 can be configured to actuate one or more of the work actuators 439 (see FIG. 6) by controlling flow of hydraulic fluid, through one or more of the conduits 492, to the work actuators 439 or to other components of the power machine. To accommodate appropriate routing and pressures for such flow, or for other hydraulic operations, the rigid tube lines of the conduits 492 (and other tube lines) can be formed of a metallic material, or other practicable material, and may maintain a predetermined geometry once installed. In some embodiments, the conduits 492 can be formed into the illustrated geometry prior to installation on the support panel 482, or after installation on the support panel 482 but prior to installation of the support panel 482 on the cab 450, such as may help to streamline assembly and final installation of the associated hydraulic circuits. The flexible hoses of the conduits 492 can be formed of a polymeric material, an elastomeric material, a combination thereof, or any other practicable material that allows for flexing or bending of the hoses during or after installation on the support panel 482.

In the embodiment shown in FIGS. 7-10, the operator input device 488 is mounted on the control valve 486 and is thus secured to the support panel 482 via the control valve 486 (and various fasteners 466). Attachment of the operator input device 488 to the support panel 482 via the control valve 486 can help to improve manufacturing processes by allowing for assembly of the control valve 486 and the operator input device 488 separately from the relevant power machine or even, initially, separately from the support panel 482. This arrangement can also reduce the need for additional conduits to hydraulically connect the two components over extended distances. In some embodiments, however, an operator input device can be secured directly to a support panel or can be used to secure other components (e.g., valves) to a support panel.

The operator input device 488 is in hydraulic communication with the control valve 486, such that the operator input device 488 can be used to control various work functions (e.g., at the lift arm assembly 430) via the control valve 486. Although illustrated as a joystick in FIGS. 7-12, the operator input device 488 can be any device that is capable of accepting a command from an operator (e.g., for control of a work function), including other joysticks, buttons, knobs, or other input devices.

The pilot valve 490 is secured to the support panel 482 via one or more of the fasteners 466 and positioned rearward of the control valve 486 when the support panel 482 is secured to the forward frame of the loader (see, e.g., FIG. 6). The pilot valve 490 is hydraulically coupled to the control valve 486 through one or more of the hydraulic conduits 492 and can regulate flow of fluid to and from the control valve 486 to assist in controlling work functions, such as the operation of an implement or other component of a power machine. The pilot valve 490 or other components can also be hydraulically coupled with the hydraulic fluid tank 480 shown schematically in FIG. 6.

As shown in FIGS. 7-8, the hydraulic filter 498 is secured on an opposite side of the support panel 482 from the control valve 486, the operator input device 488, the pilot valve 490, the cooler bracket 494, and the hydraulic cooler 496. Accordingly, in some embodiments, the hydraulic filter 498 can be positioned to be supported on a side of the support panel 482 that is closer to the operator station 455, once installed.

Figure 10:
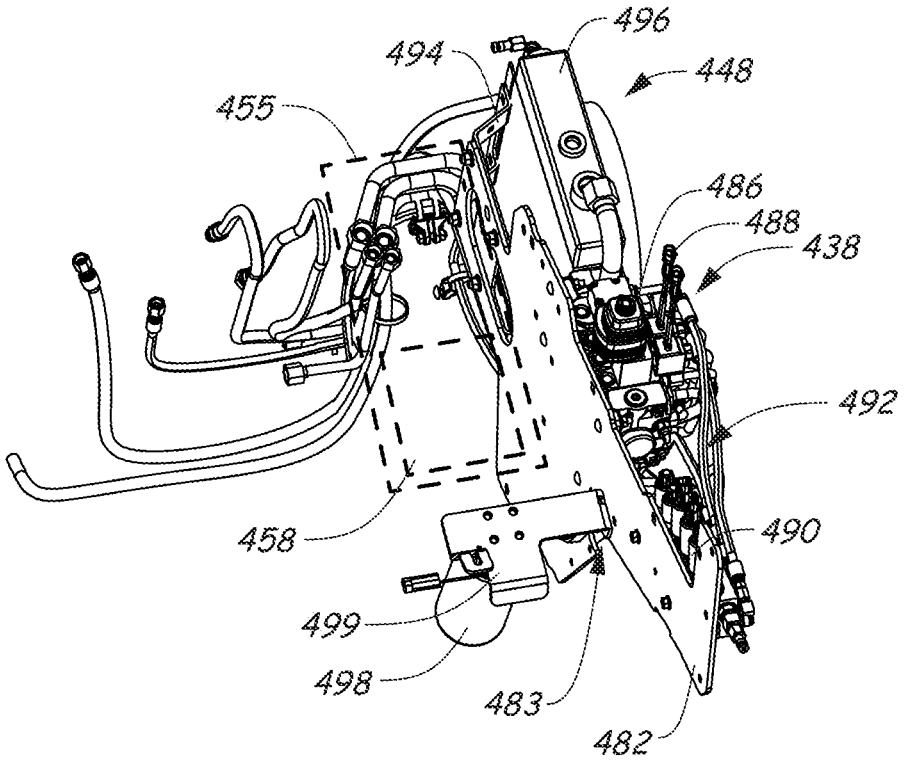
FIG. 10 is a perspective view showing generally a rear of the hydraulic sub-assembly of FIG. 7 according to embodiments of the disclosure.

In some embodiments, a hydraulic filter (or other component) can be secured to a support panel indirectly, such as via a support bracket. As illustrated in FIGS. 9-10, for example, the hydraulic filter 498 is secured to the support panel 482 with a filter bracket 499, which includes an attachment portion for securing the bracket to the support panel 482 (e.g., using fasteners or welding) and a support portion that extends in a perpendicular direction from the attachment portion (and from the support panel 482, after installation). The hydraulic filter 498 is configured to be secured to the support portion of the filter bracket 499, such that the filter bracket 499 secures the hydraulic filter 498 at a lateral offset from the support panel 482, with conduits extending from the hydraulic filter 498 across the support panel 482 to other components of the hydraulic sub-assembly 448. In some embodiments, the hydraulic filter 498 is positioned in a non-vertical orientation relative a ground surface. In such instances, the top of the filter 498 may be disposed further rearward than the bottom of the filter 498 to create additional clearance for rotation of the forward frame relative to the rear frame. Other configurations are possible, including configurations with brackets that are arranged to support a hydraulic filter at a different location (e.g., on a different side of a support panel or with different lateral or other offsets), configurations without support brackets for the filters, or configurations with different numbers or types of filters.

In some embodiments, a support panel can be configured to allow easy routing of hydraulic flow between opposing sides of the support panel. As shown in FIG. 10, for example, the support panel 482 defines a cutout 483 in general alignment with the hydraulic filter 498 and the filter bracket 499. Generally, the cutout 483 or other cutouts in a support panel can allow hydraulic flow to pass across the support panel without being routed fully around a larger outer perimeter of the support panel. In particular, in the illustrated example, a conduit 492 from the filter 498 is arranged to extend through the cutout 483, to transfer hydraulic fluid from the filter 498 to one or more components positioned on the opposing side of the support panel 482, such as the pilot valve 490, the control valve 486, or the hydraulic cooler 496. In other embodiments, other configurations are possible, including configurations with multiple cut-outs or no cut-outs at all.

In some embodiments, the filter 498 or other components can be fluidly coupled with the hydraulic cooler 496, which is installed on a forward portion 482*b* of the support panel 482, on an opposite lateral side of the support panel 482 from the filter 498. The hydraulic cooler 496 is generally configured to cool the hydraulic fluid within the work actuator circuit 438. In some embodiments, the hydraulic cooler 496 may additionally or alternatively function as a heat exchanger that is configured to cool any other fluid of the loader. In some embodiments, to further increase the flow of air along the hydraulic cooler 496, a fan 468 is mounted on or within the hydraulic cooler 496. As appropriate, the fan 468 can be driven by a motor, such as a hydraulically driven motor (not shown) within the hydraulic sub-assembly 448, or any other suitable motor.

In the embodiment shown in FIGS. 7-10, the hydraulic cooler 496 is indirectly secured to the support panel 482 by the cooler brackets 494. Further, the cooler brackets 494 have similar offset designs, such that the cooler brackets 494 support the hydraulic cooler 496 with the hydraulic cooler 496 spaced laterally apart from the support panel 482. This laterally spaced (i.e., laterally offset) arrangement can provide clearance between the hydraulic cooler 496 and the support panel 482, such that one or more of the conduits 492 can be positioned between the hydraulic cooler 496 and the support panel 482, including when the support panel 482 is secured to the frame of the loader. The positioning of the one or more of the conduits 492 between the hydraulic cooler 496 and the support panel 482 can help to reduce the required length of the relevant conduits 492 by avoiding the need to route the conduits 492 around the cooler 496. It can also protect the relevant conduits 492 during operation of the loader or can help to cool the fluid therein. Further, the lateral offset between the hydraulic cooler 496 and the support panel 482 can allow substantial air flow between the hydraulic cooler 496 and the support panel 482, which may generally help to cool the hydraulic cooler 496 and thereby improve its thermal efficiency.

In different embodiments, different bracket configurations can be used, to appropriately support a hydraulic cooler or other component relative to a support panel. For example, as shown in FIG. 9 in particular, the brackets 494 are configured as a set of substantially similar bracket members, each with a body portion 495 and a pair of opposing arms 497 that angle away from the respective body portion 495. The body portion 495 and arms 497 of each bracket 494 can be formed as a unitary component or as a single piece that is integrally formed through any practicable manufacturing process. During installation, the body portion 495 is configured to be aligned with a set of fastener locations 465, via which a set of fasteners can couple the brackets 494 to the support panel 482. Likewise, each arm 497 can be aligned to couple the brackets 494 to the hydraulic cooler 496. Use of two of the brackets 494, for example, can allow the brackets 494 to be secured on opposing sides of the opening 464 (see FIG. 8) in the support panel 482, as may contribute to useful access to cooler 496 during installation or maintenance.

As also discussed above, in some embodiments, a support panel can be configured to at least partially define a lateral (or other) side of an operator station of a power machine, such as may usefully locate one or more components supported on the support panel relative to the operator station, while also providing appropriate structural strength and enclosing structures for the operator station. In this regard, for example, an operator station 455 is schematically illustrated in FIG. 10, as well as indicated relative to the cab 450 in FIGS. 6, 11, and 12. In other embodiments, other types of operator stations can be used, including operator stations that are not necessarily defined by part or all of a cab.

Figure 11:
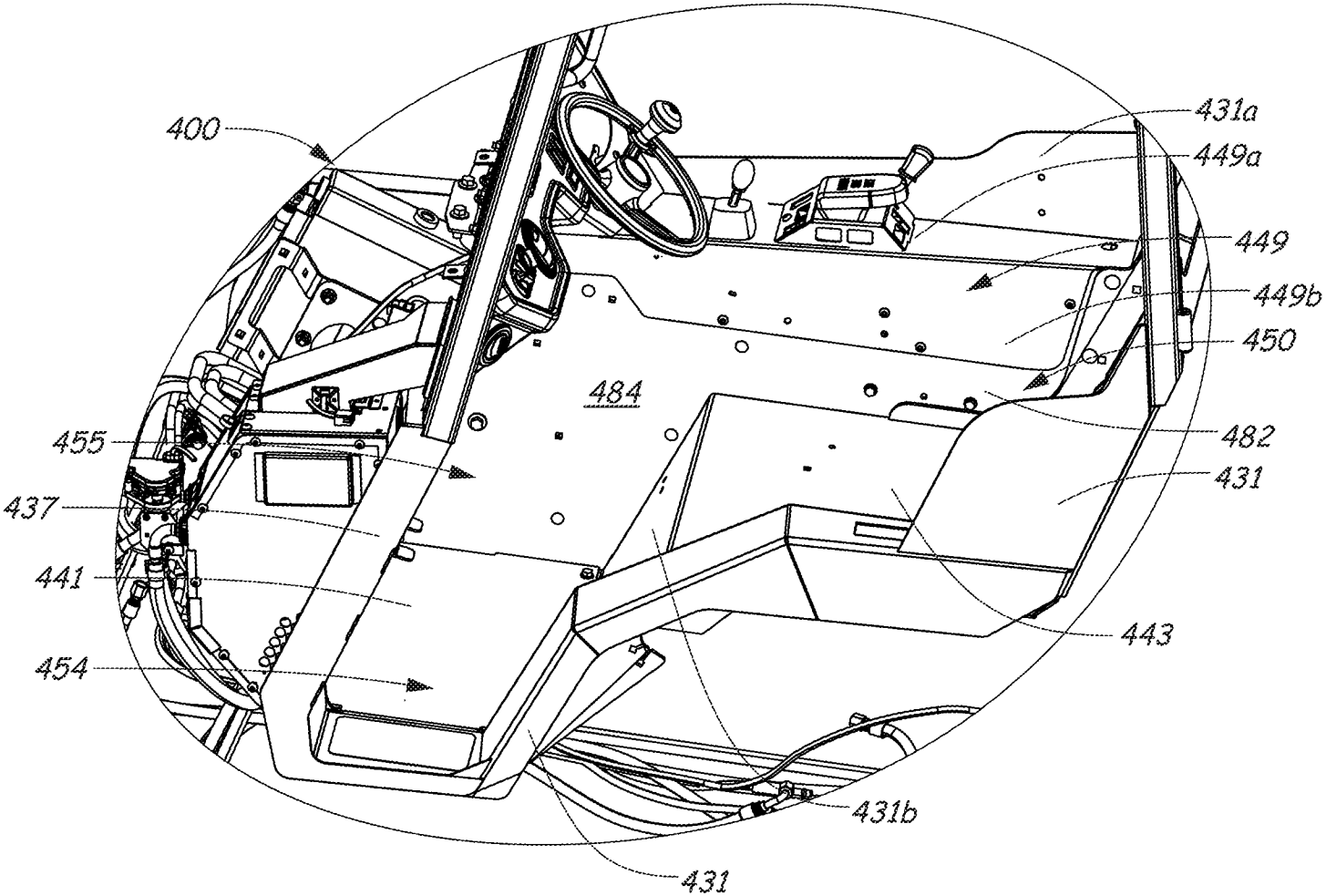
FIG. 11 is a side perspective view of the hydraulic sub-assembly of FIG. 7 installed on a power machine of the type shown in FIG. 6, to at least partially define a structural side wall of a cab of the power machine, according to embodiments of the disclosure.
Figure 12:
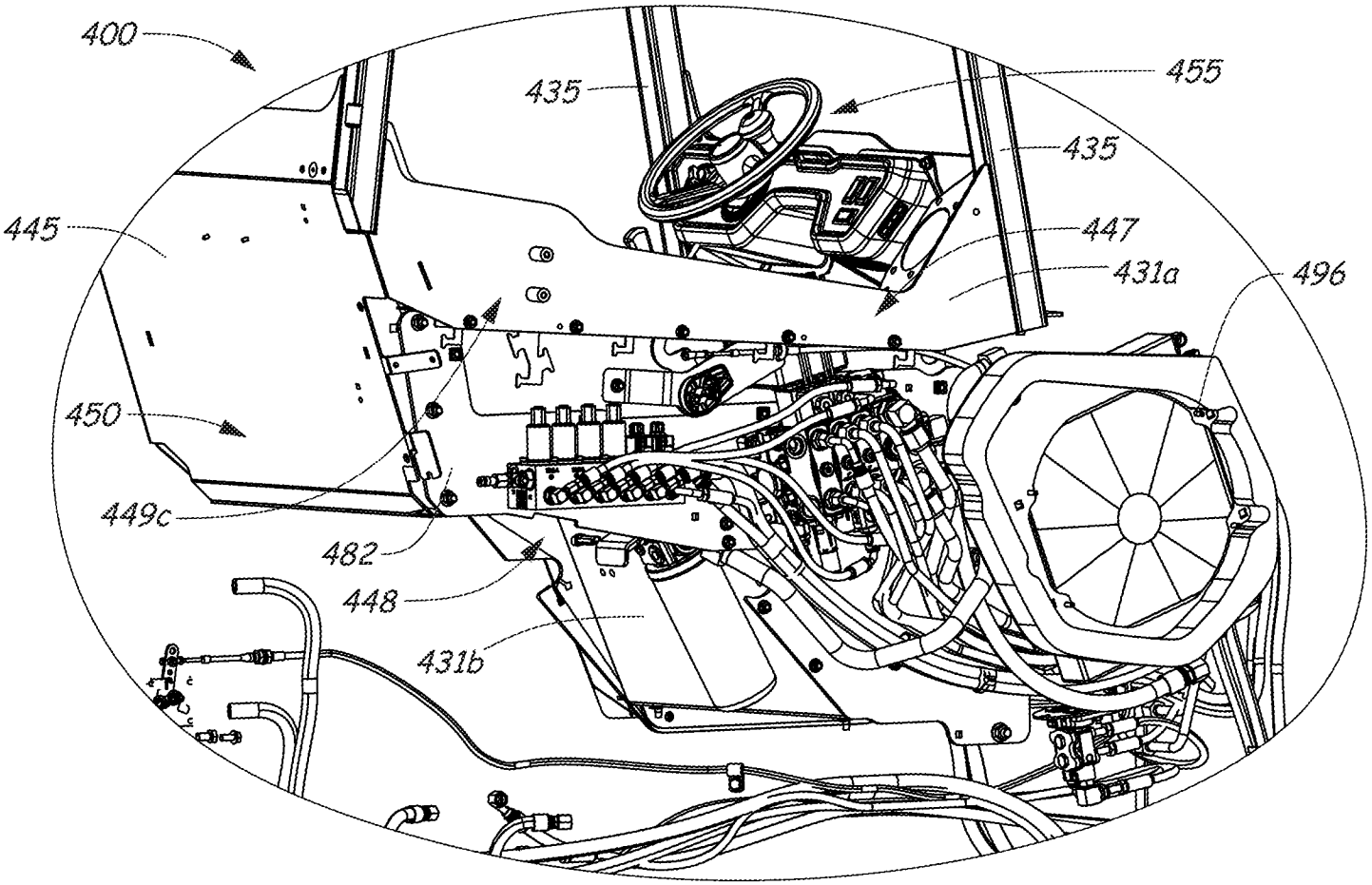
FIG. 12 is a perspective view showing generally a rear of the cab of FIG. 11, having the hydraulic sub-assembly of FIG. 7 installed thereto, according to embodiments of the disclosure.

In embodiments of a power machine that include a cab, a support panel of a hydraulic sub-assembly, alone or in conjunction with one or more body panels, can at least partially define the cab, including by providing a structural portion of the cab. For example, as illustrated in FIGS. 11 and 12, the cab 450 includes, among other structures, a plurality of body panels 431 (including panels 431*a*, 431*b*), and a plurality pillars 435, that define a portion of the cab 450 (e.g., a unitary weldment). Further, the cab 450 also includes the support panel 482, which is secured to the weldment to collectively define an outer bound of the operator station 455. In particular, the support panel 482 is secured to the weldment to provide a lateral inner structural side wall of the cab 450, adjacent to the enclosed area of the operator station 455, and generally below and laterally to the inside of the outer lateral side wall formed by the panel 431*a*. In other embodiments, however, support panels of hydraulic sub-assemblies can form other structural portions of a cab or of an operator station thereof.

In different embodiments, a cab or operator station that is at least partly defined by a support panel of a hydraulic sub-assembly can be exhibit a variety of different configurations. For example, for the cab 450, the body panels 431 at least partially define a forward wall 437 of the cab 450, a floor pan 441, a seat pan 443 that supports a seat (not shown in FIGS. 11 and 12), a rear wall 445, and a sidewall 447 opposite an entry 454, among other portions. The one or more pillars 435 extend upwardly to support a canopy that provides a roof for the operator compartment.

Like the support panel 482, the pillars 435 and body panels 431 may exhibit significant durability and reliability, and can be readily manufactured at relatively low cost, using known techniques. However, other materials and manufacturing techniques are possible. In some embodiments, the body panels 431 can be formed from multiple sheet-metal, or other, components that are secured together using fasteners, welding, adhesives, or other techniques. Likewise, the pillars 435 may be formed from as tubing (of any geometry) that is fabricated from any practicable material. The pillars 435 can have a thickness that is greater than the thickness of the body panels 431 and the support panel 482 of the sub-assembly to support the mounting of the body panels 431 and the support panel 482 thereto. In addition, the pillars 435 can have a square, tubular shape to support various body panels 431 and the support panel 484 at various offsets relative one another. Other components, such as a control panel, can also be supported by and coupled with the body panels 431, the pillars 435, and the support panel 482.

In different embodiments, the side wall of a cab opposite an entry into the cab, or any other portion of the cab, can be defined by a support panel of a hydraulic sub-assembly alone or in combination with one or more body panels that together can provide support and rigidity to the cab. In some examples, additional components, such as a control panel, may intermediately couple with a support panel and a body panel, to provide aesthetic aspects for a cab, dispose relevant components for access by an operator, or to generally also provide support and rigidity to the cab. For example, as illustrated in FIGS. 11 and 12, a body panel 431*a* forms a first, upper and laterally outer portion of the sidewall 447. The support panel 482 extends below the body panel 431*a* and forms a second, separate lower and laterally inner portion of the sidewall 447. In addition, the support panel 482 is laterally offset from the body panel 431*a* and a control panel 449 extends laterally between the support panel 482 and the body panel 431*a*. A first side of the control panel 449 may couple with the support panel 482 and a second opposite side of the control panel 449 may couple with the offset body panel 431*a* (e.g., using fasteners or welding).

In some embodiments, a control panel can be secured to a support panel of a hydraulic sub-assembly, including to provide substantial structural connections between the support panel and other portions of a cab. For example, as shown in FIGS. 11 and 12 in particular, the control panel 449 includes a laterally extending surface 449*a* and a set of depending skirt portions 449*b*, 449*c* that extend from opposing sides of the laterally extending surface 449*a*. The skirt portion 449*b* extends laterally inward of the support panel 482 and can be coupled the support panel 482 using one or more fasteners, or any other attachment method. The skirt portion 449*c* is positioned farther from the operator station 455 than the support panel 482 and is configured to be coupled with the body panel 431*a* that extends above the control panel 449 and the support panel 482. The laterally extending surface 449*a*, extending between the first and second skirt portions 449*b*, 449*c*, can support various features and components. For example, the control panel 449 may define a cup holder or a storage compartment. In addition, the control panel 449 may support various operator input devices, display panels, or other components. In some embodiments, an operator input device (e.g., the device 488) that is secured to the support panel 482 can extend through the control panel 449 for engagement by an operator or interoperation with another component within the operator station 455.

In some embodiments, a support panel may extend forwardly of the operator station and the columns that support the roof of the operator station, while still forming a side wall and a substantial structural support component of a cab. For example, as illustrated in FIG. 11, the front portion 482*b* of the support panel 482, which defines the opening 464, extends forwardly of the operator station 455. The placement of the front portion 482*b* and, correspondingly, of the cooler 496 (see FIG. 12) forward of the operator station 455 may provide various benefits. For example, as discussed above, the cooler 496 may include a fan. Further, the cooler 496 may exhaust substantial heat into the surroundings, as it cools the hydraulic fluid. During operation, noise from the fan can be minimized within the cab 450, as can heating of the cab 450 by the cooler 496, due to the placement of the cooler 496, via the arrangement of the support panel 482, forward of the operator station 455.

As shown in FIGS. 10-12, the control valve 486, the operator input device 488, the pilot valve 490, the cooler bracket 494, and the hydraulic cooler 496 can be positioned on an opposite side of the support panel 482 from the operator station 455. In some embodiments, including as illustrated in FIGS. 10-12, due to the offset orientation of the body panel 431*a* of the sidewall 447 relative to the support panel 482 disposed below the body panel 431*a*, a plurality of these components may also be disposed laterally inward of the body panel 431*a* of the sidewall 447 and below a portion of the control panel 449. This can be useful, for example, in order to dispose these components for easy access during maintenance, as well as to shield an operator from undesired exposure to these components (e.g., by orienting a large number of potential leak points away from the operator). Further, despite being on an opposite lateral side of the support panel 482 relative to the operator station 455, the operator input device 488 is positioned to extend through the control panel 449 for engagement by an operator from within the operator station 455. This arrangement can allow for easy access to the operator input device 488 by an operator within the operator station 455, for control of one or more work functions, while still preserving the various benefits noted above.

In some embodiments, configuration of certain components to be secured to a support panel with lateral offsets from the support panel can help to appropriately locate those components relative to other systems of a power machine. For example, as shown in FIGS. 10-12 in particular, the filter bracket 499 is configured to position the hydraulic filter 498 at least partly behind and below the operator station 455 when the support panel 482 is installed to form a sidewall 447 of the cab 450 (and the operator station 455). In some configurations, the operator station 455 can include an operator seat 458 (illustrated schematically in FIG. 10), and the hydraulic filter 498 may be positioned below the seat 458. More particularly, in some embodiments, the hydraulic filter 498 may be supported by the support panel 482 to be disposed on an opposite side the body panel 431*b*, which forms the seat portion, from the operator station 455. Accordingly, for example, the filter 498 may be disposed to be shielded from the operator station 455 while still being relatively easily accessible for replacement or other maintenance, even after the support panel 482 has been installed. Generally, the filter 498 is configured to remove impurities from hydraulic oil and it may accordingly need to be replaced or serviced over time. Thus, improved accessibility for a hydraulic filter, such as may be provided by the described configuration of a support panel and a hydraulic sub-assembly generally, may provide substantial benefits.

In embodiments in which a power machine does not include a cab, a support panel of a hydraulic sub-assembly according to the disclosure can form other structural parts of the power machine. For example, a support panel that is similar to the support panel 482 may define at least a portion of a sidewall of a housing of an operator station or other structure of a power machine without a cab, including by serving a substantial structural component thereof.

Figure 13:
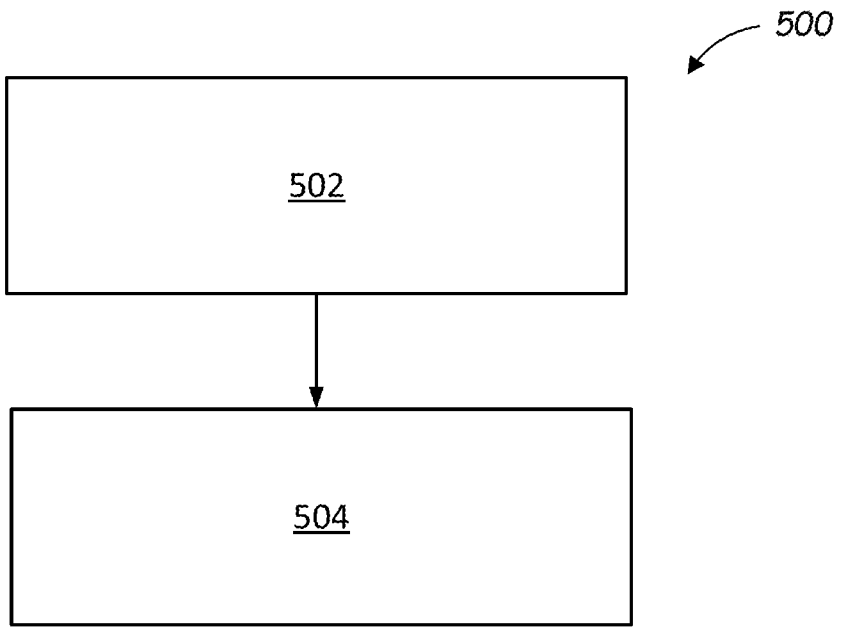
FIG. 13 is a flowchart illustrating a method of manufacturing hydraulic sub-assemblies according to embodiments of the disclosure.

As also noted above, some embodiments can include (or facilitate) improved manufacturing methods for power machines, including due to the inclusion of multiple hydraulic components in a hydraulic sub-assembly that can be installed as a whole on a frame of a power machine. FIG. 13 shows an example method 500 of manufacturing a power machine with an operator station and a frame, according to embodiments of the disclosure. In some implementations, the method can include assembling 502 a hydraulic sub-assembly that includes a support panel. The support panel can be a single-piece (e.g., integral) component, such as the panel 482 shown in FIGS. 7-10, and can be formed through any practicable manufacturing and assembly process.

Assembling 502 the hydraulic sub-assembly can also include securing a plurality of components to the support panel. Generally, as described in the examples above, a variety of hydraulic and other components can be secured to the support panel, to form a unified assembly. The components can include, for example, one or more of: a control valve (e.g., the control valve 486); an operator input device (e.g., the operator input device 488), including an operator device that is configured for hydraulic control of work functions via hydraulic communication with the control valve; a pilot valve (e.g., the pilot valve 490) that is installed in hydraulic communication with a control valve for hydraulic control of the work functions; hydraulic conduits, such as flexible hoses and rigid tube lines; a hydraulic cooler (e.g., the cooler 496, as secured with the lateral offset from the support panel); a hydraulic filter (e.g., the filter 498); and any number of other components.

In some cases, certain components can be secured to the support panel on opposite sides from each other. For example, a hydraulic filter can be secured to an opposite lateral side of a support panel from a control valve, an operator input device, a pilot valve, a hydraulic cooler, and a variety of hydraulic conduits. As another example, a hydraulic cooler can be secured to an opposite front or back portion of a support panel from a pilot valve or a hydraulic filter.

Once assembled 502, the hydraulic sub-assembly can be secured 504 to the power machine to define a portion of a sidewall of a cab or an operator station. In some embodiments, the hydraulic sub-assembly can be secured 504 to the power machine with one or more of the attached components, such as a control valve, an operator input device, a pilot valve, a cooler bracket, or a hydraulic cooler positioned on an opposite side of the support panel from an operator station. In some embodiments, the hydraulic sub-assembly can be secured 504 to the power machine with a hydraulic filter positioned at least partly behind or beneath the operator station. In some embodiments, including as described above relative to the power machine 400, the hydraulic sub-assembly can be secured 504 to a power machine to provide a structural portion of the power machine, including a structural portion (e.g., structural side wall) of a cab or of an operator station.

The embodiments provided herein can provide several advantages. For example, use of a hydraulic sub-assembly as described herein can reduce the time required to complete a production build of a loader or other power machine, as well as improve quality assurance, and potentially reduce the required labor and overhead for manufacturing. In addition, appropriate placement of components on a support panel can help to improve operability of a power machine and operator experience generally. For example, appropriate placement of hydraulic devices on a support panel can help to reduce the required length of hydraulic conduits for relevant hydraulic circuits (e.g., work actuator circuits). This can be useful, for example, to further reduce costs and minimize potential faults (e.g., leaks) within the hydraulic circuits. Similarly, filters, coolers, or other components can be readily arranged to be easily installed as part of a larger hydraulic sub-assembly, while being appropriately located and shielded relative to operator stations or other parts of a power machine and also remaining appropriately accessible for maintenance and efficient operation. In some embodiments, a hydraulic sub-assembly can also define a portion of an operator station of the power machine, such as by forming at least a portion of a wall of a cab that contains the operator station. In this regard, and in particular when a support panel of the hydraulic sub-assembly forms a structural portion of a cab, the amount of material needed for the remaining body panels or other parts of the cab may be reduced substantially, thereby potentially reducing the material cost and weight of the power machine as well as total manufacturing time.

Although the present invention has been described with reference to preferred embodiments, workers skilled in the art will recognize that changes may be made in form and detail to the disclosed embodiments without departing from the spirit and scope of the concepts discussed herein.

What is claimed is:

1. A hydraulic sub-assembly for use with a power machine with a cab that includes an operator station, the hydraulic sub-assembly comprising:

a support panel configured to be secured to a lateral side of the cab; and a plurality of components secured to and supported by the support panel;

the plurality of components including:

a control valve;

an operator input device configured for control of hydraulic work functions of the power machine, the operator input device being mounted on and in hydraulic communication with the control valve;

a pilot valve configured to facilitate interoperation of the control valve and the operator input device;

hydraulic conduits including one or more tube lines and one or more flexible hoses;

a hydraulic cooler; and a hydraulic filter; and the support panel being configured to define a structural side wall of the cab, with one or more of the control valve, the operator input device, the pilot valve, or the hydraulic cooler positioned opposite the support panel from the operator station.

2. The hydraulic sub-assembly of claim 1, wherein the support panel is configured to form part of an inner lateral side wall of the cab that faces the operator station.

3. The hydraulic sub-assembly of claim 1, wherein the hydraulic filter is positioned on an opposite side of the support panel from the one or more of the control valve, the operator input device, the pilot valve, or the hydraulic cooler.

4. The hydraulic sub-assembly of claim 3, wherein the hydraulic filter is positioned on an opposite side of the support panel from each of the control valve, the operator input device, the pilot valve, and the hydraulic cooler.

5. The hydraulic sub-assembly of claim 4, wherein the hydraulic filter is configured to be positioned at least partly behind or below the operator station of the cab.

6. The hydraulic sub-assembly of claim 1, wherein the hydraulic cooler is supported by a cooler bracket that is configured to space the hydraulic cooler laterally apart from the support panel to provide a clearance between the hydraulic cooler and the support panel.

7. The hydraulic sub-assembly of claim 6, wherein the cooler bracket supports the hydraulic cooler over an access opening in the support panel.

8. The hydraulic sub-assembly of claim 6, wherein one or more of the hydraulic conduits are routed through the clearance between the hydraulic cooler and the support panel.

9. The hydraulic sub-assembly of claim 1, wherein the support panel is made from a unitary piece of material.

10. An articulated loader comprising:

a cab that defines an operator station and is supported on a front frame member of an articulated frame; and a hydraulic sub-assembly that includes:

a support panel that is securable to the cab and forms at least part of a structural side wall of the cab, laterally adjacent to the operator station; and a control valve secured to the support panel to be supported by the support panel relative to the cab, the control valve being configured to provide hydraulic control of work functions of the articulated loader based on inputs from an operator within the operator station.

11. The articulated loader of claim 10, wherein the hydraulic sub-assembly includes a plurality of hydraulic components supported by the support panel, the plurality of hydraulic components including two or more of:

an operator input device configured to provide the inputs to the control valve;

a pilot valve configured to facilitate interoperation of the control valve and the operator input device;

hydraulic conduits including one or more tube lines and one or more flexible hoses;

a hydraulic cooler; and a hydraulic filter.

12. The articulated loader of claim 11, wherein the operator input device, the pilot valve the hydraulic conduits, and the hydraulic cooler are supported by the support panel to be on an opposite lateral side of the support panel from the operator station.

13. The articulated loader of claim 12, wherein the control valve and the hydraulic cooler are supported on a front portion of the support panel; and wherein the pilot valve is supported on a rear portion of the support panel.

14. The articulated loader of claim 13, wherein the pilot valve is supported on an elevated portion of the support panel that is configured to pivot with the cab, to extend over a rear frame member of the articulated frame, when the front frame member pivots relative to the rear frame member.

15. The articulated loader of claim 12, wherein the hydraulic cooler is supported by the support panel to be at least partly forward of the operator station, with a lateral clearance provided between the hydraulic cooler and the support panel.

16. The articulated loader of claim 15, wherein the hydraulic filter is supported by the support panel to be on a same lateral side of the support panel as the operator station.

17. The articulated loader of claim 16, wherein the hydraulic filter is supported by the support panel to be at least partly below and behind the operator station.

18. A method of manufacturing a power machine, the method comprising:

assembling a hydraulic sub-assembly, including:

providing a support panel; and securing a control valve and a plurality of hydraulic components to the support panel; and securing the hydraulic sub-assembly to a frame of the power machine to support the control valve and the plurality of hydraulic components relative to the frame, with the support panel defining a structural portion of a lateral side of a cab of the power machine;

wherein the plurality of hydraulic components include: an operator input device that is configured for hydraulic control of work functions of the power machine via hydraulic communication with the control valve;

a pilot valve in hydraulic communication with the control valve for hydraulic control of the work functions;

hydraulic conduits including one or more tube lines and one or more flexible hoses;

a cooler bracket;

a hydraulic cooler secured to the cooler bracket, with one or more of the hydraulic conduits extending through a lateral clearance between the hydraulic cooler and the support panel; and a hydraulic filter.

19. The method of claim 18, wherein the hydraulic sub-assembly is secured to the frame of the power machine with the control valve, the operator input device, the pilot valve, the cooler bracket, and the hydraulic cooler positioned opposite the support panel from an operator station of the cab, and with the hydraulic filter positioned on the same side of the support panel as the operator station and at least partly beneath the operator station.

* * * * *